US009068766B2

(12) United States Patent
Tamaki et al.

(10) Patent No.: US 9,068,766 B2
(45) Date of Patent: Jun. 30, 2015

(54) AIR-CONDITIONING AND HOT WATER SUPPLY COMBINATION SYSTEM

(75) Inventors: Shogo Tamaki, Tokyo (JP); Kosuke Tanaka, Tokyo (JP); Fumitake Unezaki, Tokyo (JP); Hirokuni Shiba, Tokyo (JP); Yuto Shibao, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 402 days.

(21) Appl. No.: 13/638,935

(22) PCT Filed: Apr. 5, 2010

(86) PCT No.: PCT/JP2010/002480

§ 371 (c)(1),
(2), (4) Date: Oct. 2, 2012

(87) PCT Pub. No.: WO2011/125111

PCT Pub. Date: Oct. 13, 2011

(65) Prior Publication Data

US 2013/0019624 A1 Jan. 24, 2013

(51) Int. Cl.

| | |
|---|---|
| ***F25B 13/00*** | (2006.01) |
| ***F24D 17/02*** | (2006.01) |
| ***F25B 29/00*** | (2006.01) |

(52) U.S. Cl.

CPC ..... *F25B 13/00* (2013.01); *F24D 17/02* (2013.01); *F25B 2313/02334* (2013.01); (Continued)

(58) Field of Classification Search

CPC ..... F25B 6/02; F25B 13/00; F25B 30/02; F25B 2313/02334; F25B 2313/0313; F25B 2400/04; F25B 2400/05; F25B 2600/2501

USPC ..... 62/160, 196.1, 196.4, 197, 222, 225, 62/513

See application file for complete search history.

(56) References Cited

U.S. PATENT DOCUMENTS

| | | | | |
|---|---|---|---|---|
| 5,117,645 | A * | 6/1992 | Bryant | 62/174 |
| 5,347,826 | A * | 9/1994 | Hayashida et al. | 62/197 |
| 2006/0048539 | A1 | 3/2006 | Takechi et al. | |

FOREIGN PATENT DOCUMENTS

| | | | |
|---|---|---|---|
| CN | 1738995 | A | 2/2006 |
| CN | 101666560 | A | 3/2010 |

(Continued)

OTHER PUBLICATIONS

Office Action (Decision of Refusal) issued on May 7, 2014, by the Japanese Patent Office in corresponding Japanese Patent Application No. 2012-509173, and an English Translation of the Office Action. (5 pages).

(Continued)

*Primary Examiner* — Marc Norman

(74) *Attorney, Agent, or Firm* — Buchanan Ingersoll & Rooney PC

(57) ABSTRACT

Provided is an air-conditioning and hot water supply combination system capable of maintaining a high hot water supply capacity and achieving high efficiency even under high-temperature outside air conditions by appropriately controlling the degree of superheat and the degree of subcooling of a heat exchanger. In an air-conditioning and hot water supply combination system, when an evaporating pressure or an evaporating temperature calculated from the evaporating pressure reaches a first predetermined value or higher, the degree of superheat of a refrigerant on a low-pressure gas side of a subcooling heat exchanger or the degree of subcooling of the refrigerant on a high-pressure liquid side of the subcooling heat exchanger is controlled by the opening degree of a low-pressure bypass pressure reducing mechanism, such that the evaporating pressure or the evaporating temperature calculated from the evaporating pressure is less than or equal to the first predetermined value.

15 Claims, 6 Drawing Sheets

(52) U.S. Cl.
CPC *F25B 2313/02741* (2013.01); *F25B 2339/047* (2013.01); *F25B 2400/13* (2013.01); *F25B 2600/19* (2013.01); *F25B 2600/21* (2013.01); *F25B 2600/2513* (2013.01); *F25B 29/003* (2013.01); *F25B 2313/021* (2013.01)

(56) References Cited

FOREIGN PATENT DOCUMENTS

| | | | |
|---|---|---|---|
| JP | 5-5577 | A | 1/1993 |
| JP | 6-76864 | B2 | 9/1994 |
| JP | 6-265232 | A | 9/1994 |
| JP | 7-4756 | A | 1/1995 |
| JP | 2554208 | B2 | 11/1996 |
| JP | 11-14177 | A | 1/1999 |
| JP | 2001-235253 | A | 8/2001 |
| JP | 2006-112708 | | 4/2006 |
| JP | 2007-64510 | A | 3/2007 |
| JP | 2009-139014 | A | 6/2009 |
| JP | 2009-243793 | A | 10/2009 |

OTHER PUBLICATIONS

*International Search Report (PCT/ISA/210) issued on Jul. 13, 2010, by the Japanese Patent Office as the International Searching Authority for International Application No. PCT/JP2011/002480.

Extended European Search Report dated Nov. 3, 2014 issued in corresponding European Patent Appln. No. 10849360.2 (9 pages).

Office Action (Notice of Reasons for Refusal) issued on Sep. 24, 2013, by the Japanese Patent Office in corresponding Japanese Patent Application No. 2012-509173, and an English Translation of the Office Action. (7 pages).

Office Action dated Jun. 5, 2014 issued in corresponding Chinese Patent Appln. No. 201080065784.6, with English translation (15 pages).

* cited by examiner

FIG. 3

| | HEATING ONLY OPERATION (HOT WATER SUPPLY & HEATING) | HEATING MAIN OPERATION (HOT WATER SUPPLY & COOLING) | COOLING ONLY OPERATION (COOLING) | COOLING MAIN OPERATION (HOT WATER SUPPLY & COOLING) |
|---|---|---|---|---|
| FOUR-WAY VALVE 11 | SOLID LINES | SOLID LINES | BROKEN LINES | BROKEN LINES |
| FIRST SOLENOID VALVE 2 | OPENED | OPENED | CLOSED | OPENED |
| SECOND SOLENOID VALVE 10 | OPENED | CLOSED | OPENED | OPENED |
| THIRD SOLENOID VALVE 27 | CLOSED | OPENED | CLOSED | CLOSED |

FIG. 5
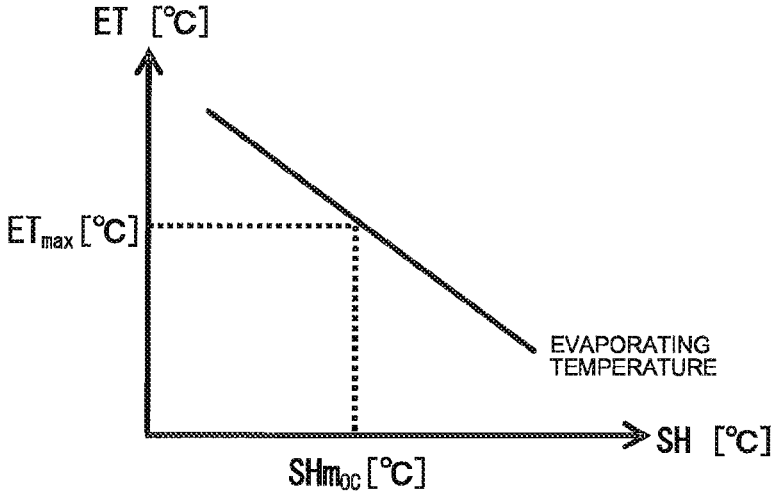
(a) RELATIONSHIP BETWEEN DEGREE OF SUPERHEAT AND EVAPORATING TEMPERATURE
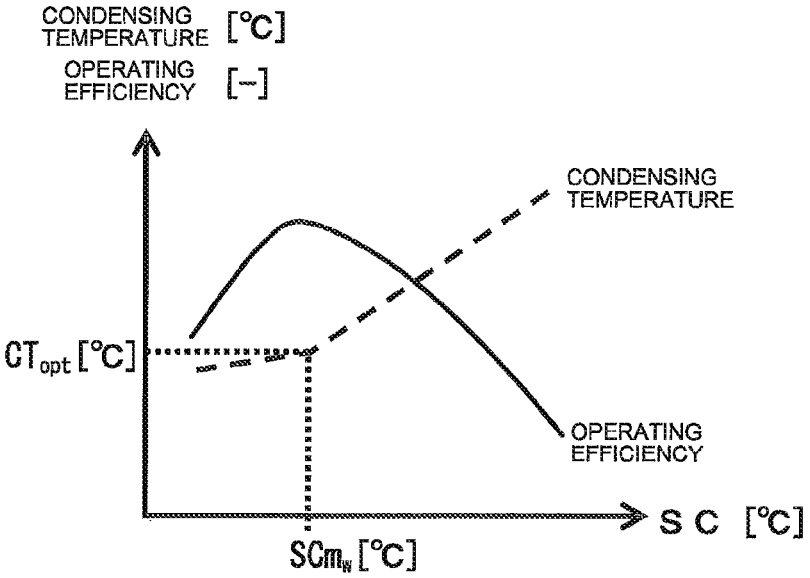
(b) RELATIONSHIP BETWEEN DEGREE OF SUBCOOLING, PRESSURE ON HIGH-PRESSURE SIDE, AND OPERATING EFFICIENCY

AIR-CONDITIONING AND HOT WATER SUPPLY COMBINATION SYSTEM

TECHNICAL FIELD

The present invention relates to air-conditioning and hot water supply combination systems capable of simultaneously executing an air-conditioning operation (cooling operation, heating operation) and a hot water supply operation, and in particular, relates to an air-conditioning and hot water supply combination system that achieves a highly efficient operation state.

BACKGROUND ART

There have been air-conditioning and hot water supply combination systems, each of which is equipped with a refrigerant circuit including a heat source unit (outdoor unit), a use unit (indoor unit), and a hot water supply unit (water heater) such that the use unit and the hot water supply unit are connected to the heat source unit through pipes, and is capable of simultaneously executing an air-conditioning operation and a hot water supply operation (refer to Patent Literatures 1 to 3, for example).

In such an air-conditioning and hot water supply combination system, a plurality of use units are connected to the heat source unit through connecting pipes (refrigerant pipes), so that each use unit can execute a cooling operation or heating operation. In addition, the hot water supply unit is connected to the heat source side unit by connecting pipes or a cascade system, so that the hot water supply unit can execute the hot water supply operation. In other words, the air-conditioning operation by the use side unit and the hot water supply operation by the hot water supply unit can be simultaneously executed. Furthermore, in the case where the use unit performs the cooling operation in the air-conditioning and hot water supply combination system, execution of the hot water supply operation by the hot water supply unit enables to recover exhaust heat in the cooling operation, thus achieving highly efficient operations.

CITATION LIST

Patent Literature

Patent Literature 1: Japanese Patent No. 2554208 (p. 3, FIG. 1, for example)

Patent Literature 2: Japanese Examined Patent Application Publication No. 6-76864 (pp. 2-4, FIG. 2, for example)

Patent Literature 3: Japanese Unexamined Patent Application Publication No. 2009-243793 (p. 5, FIG. 1, for example)

SUMMARY OF INVENTION

Technical Problem

In the air-conditioning and hot water supply combination system including the cascade system disclosed in Patent Literature 1, in order to rapidly supply high-temperature hot water with high efficiency, two refrigerant circuits are arranged to perform the hot water supply operation. This may therefore give the effects of increasing water heating capacity and reducing time for hot water supply. In the air-conditioning and hot water supply combination system disclosed in Patent Literature 1, however, the arrangement of the two refrigerant circuits leads to an increased size of the system. Disadvantageously, more installation space is needed.

In the air-conditioning and hot water supply combination system disclosed in Patent Literature 2, a single refrigerant circuit performs hot water supply. Accordingly, the system can be made smaller than the air-conditioning and hot water supply combination system disclosed in Patent Literature 1. However, in the case where the hot water supply operation required to supply hot water at a high temperature, e.g., 60 degrees C. or higher, is executed on condition that the temperature of outside air is high, for example, during the summer (under high-temperature outside air conditions), a pressure on a high-pressure side and a pressure on a low-pressure side tend to increase. Disadvantageously, the hot water supply capacity is reduced. Furthermore, the compression ratio of a compressor is high during high-temperature hot water supply. Accordingly, the efficiency of operation will probably be reduced.

The air-conditioning and hot water supply combination system disclosed in Patent Literature 3 relates to a technique for the hot water supply operation on condition that the temperature of outside air is low (low-temperature outside air conditions). Controlling the flow rate of injection to a compressor in accordance with a condensing temperature enables the hot water supply operation under low-temperature outside air conditions. Patent Literature 3, however, includes no description about the hot water supply operation under high-temperature outside air conditions in the disclosed air-conditioning and hot water supply combination system.

The present invention has been made in consideration of the above-described disadvantages and an object of the present invention is to provide an air-conditioning and hot water supply combination system which appropriately controls the degree of superheat and the degree of subcooling of a heat exchanger such that a high hot water supply capacity can be maintained even under high-temperature outside air conditions and a highly efficient operation state can be maintained.

Solution to Problem

The present invention provides an air-conditioning and hot water supply combination system including one or a plurality of use units each equipped with at least a use side heat exchanger, one or a plurality of hot water supply units each equipped with at least a hot water supply side heat exchanger, one or a plurality of heat source units connected to the use units and the hot water supply units, each heat source unit being equipped with a compressor, a heat source side heat exchanger, a heat source side pressure reducing mechanism, a bypass that bypasses a liquid refrigerant on a high-pressure side to a low-pressure side, a low-pressure bypass pressure reducing mechanism disposed in the bypass, an accumulator, and a subcooling heat exchanger that exchanges heat between the liquid refrigerant on the high-pressure side and the refrigerant on the low-pressure side flowing through the bypass, and one or a plurality of branch units connected to the use units, the hot water supply units, and the heat source units, each branch unit being equipped with a use side pressure reducing mechanism that controls the flow of the refrigerant flowing into the use unit in accordance with an operation state in the use unit, and a hot water supply pressure reducing mechanism that controls the flow of the refrigerant flowing into the hot water supply unit in accordance with an operation state in the hot water supply unit, wherein when an evaporating pressure or an evaporating temperature calculated from the evaporating pressure reaches a first predetermined value or higher, the degree of superheat of the refrigerant on the low-pressure gas side of the subcooling heat exchanger or the degree of subcooling of the refrigerant on the high-pressure liquid side of the subcooling heat exchanger is controlled by the opening degree of the low-pressure bypass pressure reducing mechanism, such that the evaporating pressure or the evaporating temperature calculated from the evaporating pressure is less than or equal to the first predetermined value.

The present invention provides an air-conditioning and hot water supply combination system including one or a plurality of use units each equipped with at least a use side heat exchanger, one or a plurality of hot water supply units each equipped with at least a hot water supply side heat exchanger, one or a plurality of heat source units connected to the use units and the hot water supply units, each heat source unit being equipped with a compressor, a heat source side heat exchanger, a heat source side pressure reducing mechanism, and a receiver, and one or a plurality of branch units connected to the use units, the hot water supply units, and the heat source units, each branch unit being equipped with a use side pressure reducing mechanism that controls the flow of a refrigerant flowing into the use unit in accordance with an operation state in the use unit, and a hot water supply pressure reducing mechanism that controls the flow of the refrigerant flowing into the hot water supply unit in accordance with an operation state in the hot water supply unit, wherein when an evaporating pressure or an evaporating temperature calculated from the evaporating pressure reaches a first predetermined value or higher, the degree of superheat on the gas side of the heat source side heat exchanger or the degree of superheat on the gas side of the use side heat exchanger is controlled by the opening degree of the heat source side pressure reducing mechanism or the use side pressure reducing mechanism, such that the evaporating pressure or the evaporating temperature calculated from the evaporating pressure is less than or equal to the first predetermined value.

Advantageous Effects of Invention

According to the air-conditioning and hot water supply combination systems of the present invention, a high hot water supply capacity can be maintained and a highly efficient operation state can also be maintained even under high-temperature outside air conditions.

BRIEF DESCRIPTION OF DRAWINGS

FIG. 3 is a table illustrating details of operations of a four-way valve and solenoid valves in operation modes of a heat source unit.

FIG. 5 includes schematic diagrams explaining a change in evaporating temperature with respect to the degree of superheat, or a change in operation efficiency and condensing temperature with respect to the degree of subcooling.

DESCRIPTION OF EMBODIMENTS

Embodiments of the present invention will be described below with reference to the drawings.

Embodiment 1

Figure 1:
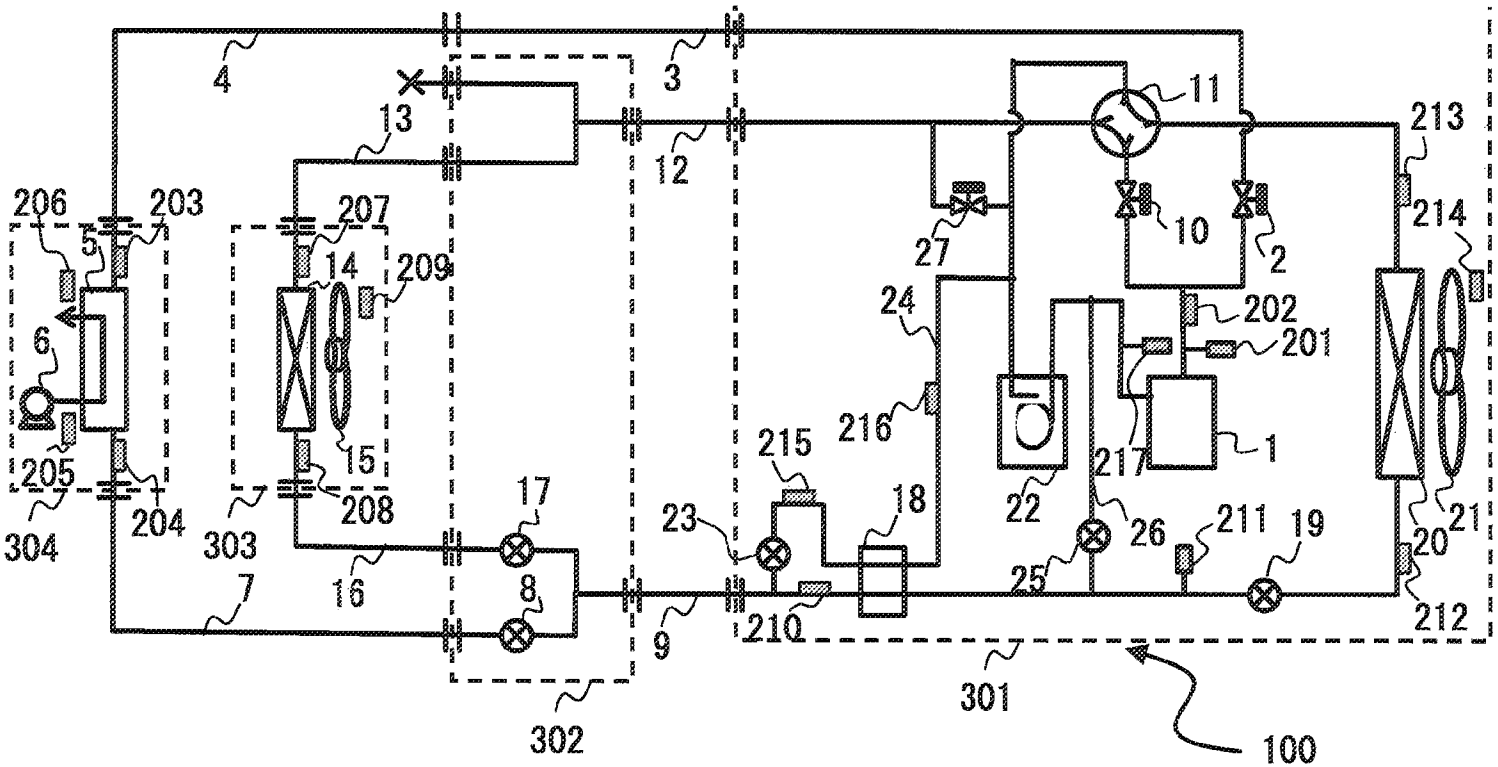
FIG. 1 is a refrigerant circuit diagram illustrating the configuration of a refrigerant circuit in an air-conditioning and hot water supply combination system according to Embodiment 1 of the present invention.
Figure 2:
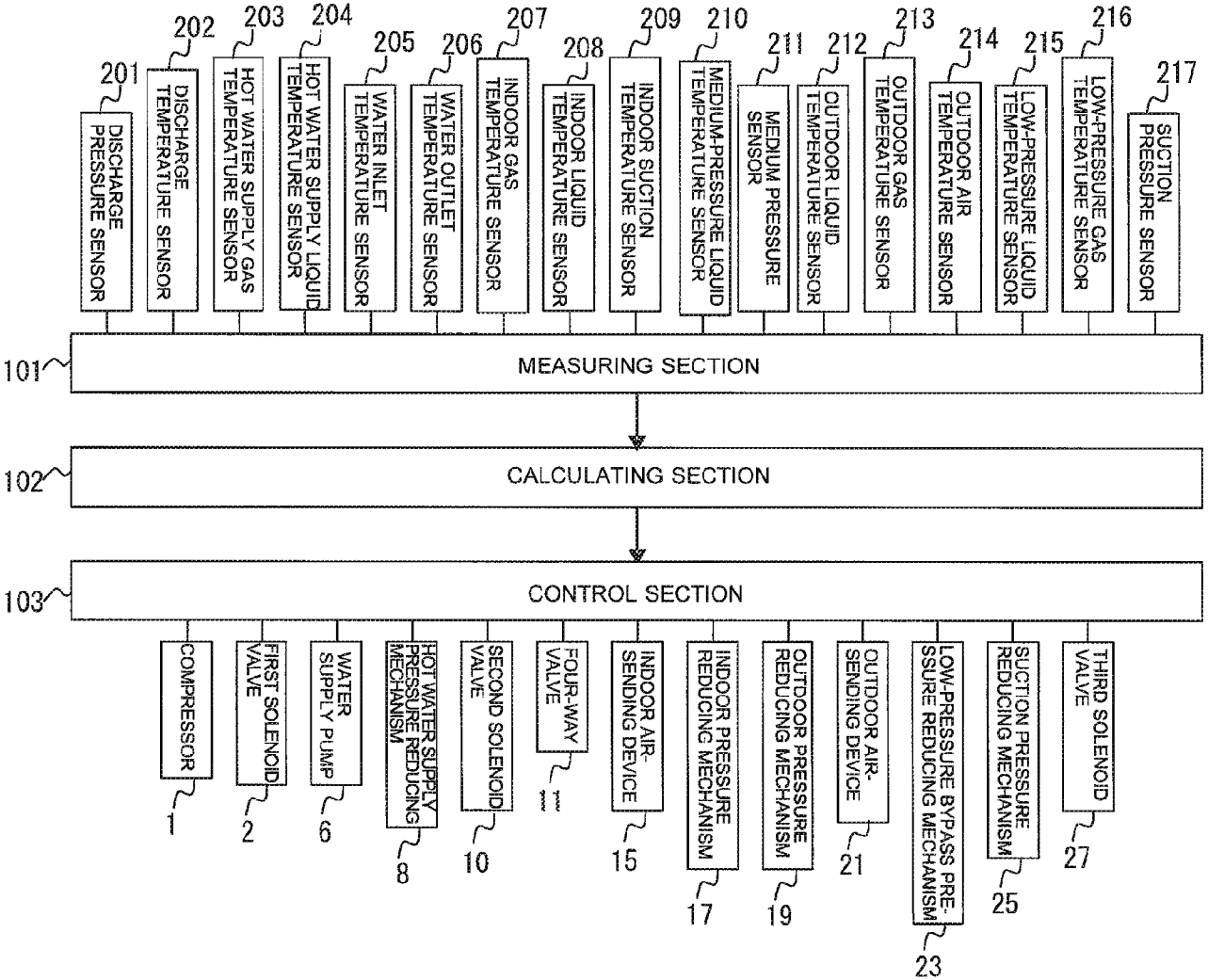
FIG. 2 is a schematic diagram schematically illustrating processes for information from various sensors and components to be controlled in the air-conditioning and hot water supply combination system according to Embodiment 1 of the present invention.
Figure 4:
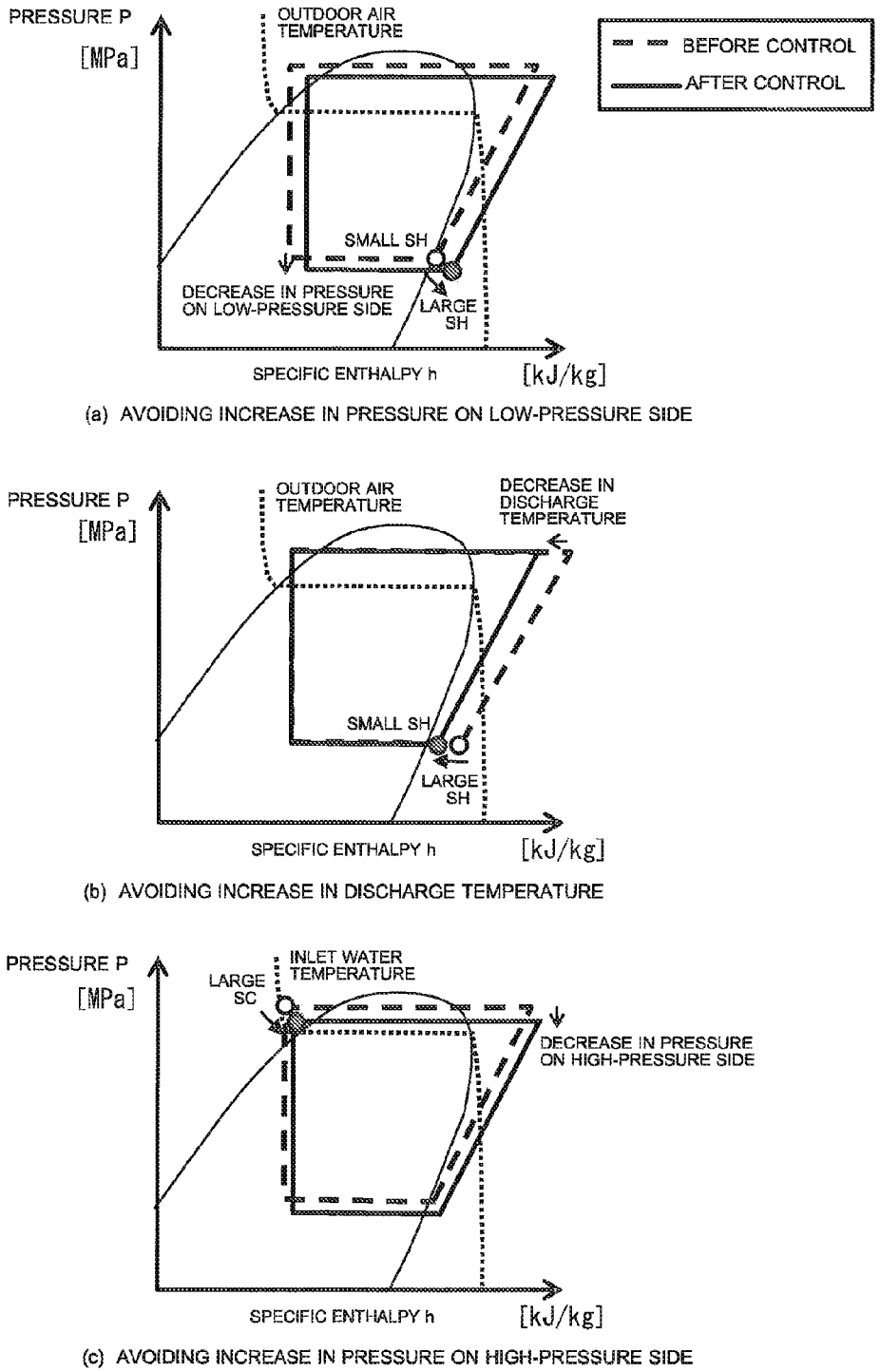
FIG. 4 includes schematic explanatory diagrams explaining controls for avoiding an increase in pressure on a low-pressure side, an increase in pressure on a high-pressure side, and an increase in discharge temperature under high-temperature outside air conditions, the controls being executed by the air-conditioning and hot water supply combination system according to Embodiment 1 of the present invention.

FIG. 1 is a refrigerant circuit diagram illustrating the configuration of a refrigerant circuit in an air-conditioning and hot water supply combination system 100 according to Embodiment 1 of the present invention. FIG. 2 is a schematic diagram schematically illustrating processes for information of various sensors and components to be controlled in the air-conditioning and hot water supply combination system 100. FIG. 3 is a table illustrating details of operations of a four-way valve 11 and solenoid valves in operation modes of a heat source unit 301. FIG. 4 includes schematic explanatory diagrams explaining controls, executed by the air-conditioning and hot water supply combination system 100, for avoiding an increase in pressure on a low-pressure side, an increase in pressure on a high-pressure side, and an increase in discharge temperature under high-temperature outside air conditions. FIG. 5 includes schematic diagrams explaining a change in evaporating temperature with respect to the degree of superheat or a change in condensing temperature and operation efficiency with respect to the degree of subcooling. The configuration and operation of the air-conditioning and hot water supply combination system 100 will be described with reference to FIGS. 1 to 5. Furthermore, the dimensional relationship among components in FIG. 1 and the other figures may be different from the actual one.

This air-conditioning and hot water supply combination system 100 is a 3-pipe multi-system air-conditioning and hot water supply combination system which performs a thermo-compression refrigeration cycle operation to simultaneously enable a cooling operation or heating operation selected in a use side unit and a hot water supply operation in a hot water supply unit. This air-conditioning and hot water supply combination system 100 can simultaneously perform the air-conditioning operation and the hot water supply operation, and can also maintain a high hot water supply temperature and achieve highly efficient operations even under high-temperature outside air conditions.

[System Configuration]

The air-conditioning and hot water supply combination system 100 includes the heat source unit 301, a branch unit 302, and a use unit 303. The heat source unit 301 and the branch unit 302 are connected by a liquid extension pipe 9, serving a refrigerant pipe, and a gas extension pipe 12, serving as a refrigerant pipe. One side of a hot water supply unit 304 is connected to the heat source unit 301 through a hot water supply gas pipe 4, serving as a refrigerant pipe, and a hot water supply extension pipe 3, serving as a refrigerant pipe. The other side thereof is connected to the branch unit 302 through a hot water supply liquid pipe 7, serving as a refrigerant pipe. The use unit 303 and the branch unit 302 are connected by an indoor gas pipe 13, serving as a refrigerant pipe, and an indoor liquid pipe 16, serving as a refrigerant pipe.

In Embodiment 1, the case where the single use unit and the single hot water supply unit are connected to the single heat source unit is illustrated. The arrangement is not limited to this case. As regards each unit, the number of units may be greater than or equal to that illustrated in the drawings. Furthermore, examples of refrigerant used in the air-conditioning and hot water supply combination system 100 include HFC (hydrofluorocarbon) refrigerants, such as R410A, R407C, and R404A, HCFC (hydrochlorofluorocarbon) refrigerants, such as R22 and R134a, and natural refrigerants, such as hydrocarbon, helium, and carbon dioxide.

<Operation Modes of Heat Source Unit 301>

Operation modes which the air-conditioning and hot water supply combination system 100 can execute will be described in brief. In the air-conditioning and hot water supply combination system 100, an operation mode of the heat source unit 301 is determined depending on the ratio between a hot water supply load of the connected hot water supply unit 304 and a cooling load and a heating load of the use units 303. The air-conditioning and hot water supply combination system 100 is configured to execute any of four operation modes (heating only operation mode, heating main operation mode, cooling only operation mode, and cooling main operation mode).

The heating only operation mode is an operation mode of the heat source unit 301 in the case where the hot water supply operation by the hot water supply unit 304 and the heating operation by the use unit 303 are simultaneously executed. The heating main operation mode is an operation mode of the heat source unit 301 in the case where the hot water supply operation by the hot water supply unit 304 and the cooling operation by the use unit 303 are simultaneously performed and the hot water supply load is larger. The cooling main operation mode is an operation mode of the heat source unit 301 in the case where the hot water supply operation by the hot water supply unit 304 and the cooling operation by the use unit 303 are simultaneously performed and the cooling load is larger. The cooling only operation mode is an operation mode of the heat source unit 301 in the case where there is no hot water supply load and the use unit 303 carries out the cooling operation.

<Use Unit 303>

The use unit 303 is installed in a place (for example, in or on an indoor ceiling in a concealed or suspended manner, or on a wall in a hanging manner) where conditioned air can be blown to a conditioned area. The use unit 303 is connected to the heat source unit 301 through the branch unit 302, the liquid extension pipe 9, and the gas extension pipe 12, and constitutes part of the refrigerant circuit in the air-conditioning and hot water supply combination system 100.

The use unit 303 includes an indoor side refrigerant circuit constituting part of the refrigerant circuit. This indoor side refrigerant circuit includes, as a component, an indoor heat exchanger 14 which serves as a use side heat exchanger. The use unit 303 further includes an indoor air-sending device 15 for supplying conditioned air, which has exchanged heat with the refrigerant in the indoor heat exchanger 14, to the conditioned area, such as an indoor space.

The indoor heat exchanger 14 may be, for example, a cross-fin type fin-and-tube heat exchanger including a heat transfer tube and many fins. Alternatively, the indoor heat exchanger 14 may be, for example, a microchannel heat exchanger, a shell and tube heat exchanger, a heat pipe heat exchanger, or a double pipe heat exchanger. In the case where the operation mode executed by the air-conditioning and hot water supply combination system 100 is a cooling operation mode (the cooling only operation mode or the cooling main operation mode), the indoor heat exchanger 14 functions as a refrigerant evaporator to cool the air in the conditioned area. In a heating operation mode (the heating only operation mode or the heating main operation mode), the indoor heat exchanger 14 functions as a refrigerant condenser (or radiator) to heat the air in the conditioned area.

The indoor air-sending device 15 has functions of sucking the indoor air into the use unit 303 to allow the indoor heat exchanger 14 to exchange heat with the indoor air, and then supplying the resultant air as conditioned air to the conditioned area. In other words, the use unit 303 enables to exchange heat between the indoor air taken in by the indoor air-sending device 15 and the refrigerant flowing through the indoor heat exchanger 14. The indoor air-sending device 15 includes a component capable of changing the flow rate of conditioned air supplied to the indoor heat exchanger 14. For example, the indoor air-sending device 15 includes a fan, such as a centrifugal fan or a multi-blade fan, and a motor, such as a DC fan motor.

The use unit 303 further includes the following various sensors: an indoor gas temperature sensor 207, disposed on the gas side of the indoor heat exchanger 14, for detecting the temperature of a gas refrigerant; an indoor liquid temperature sensor 208, disposed on the liquid side of the indoor heat exchanger 14, for detecting the temperature of a liquid refrigerant; and an indoor suction temperature sensor 209, disposed on the indoor air suction inlet side of the use unit 303, for detecting the temperature of the indoor air flowing into the use unit 303.

Furthermore, an operation of the indoor air-sending device 15 is controlled by a control section 103, functioning as normal operation control means for executing a normal operation including the cooling operation mode and the heating operation mode of the use unit 303 (refer to FIG. 2).

<Hot Water Supply Unit 304>

The hot water supply unit 304 has a function of supplying hot water boiled by a boiler (not illustrated) installed in, for example, an outdoor location. One side of the hot water supply unit 304 is connected to the heat source unit 301 through the hot water supply gas pipe 4 and the hot water supply extension pipe 3 and the other side thereof is connected to the branch unit 302 through the hot water supply liquid pipe 7, and constitutes part of the refrigerant circuit in the air-conditioning and hot water supply combination system 100.

The hot water supply unit 304 includes a hot water supply side refrigerant circuit constituting part of the refrigerant circuit. This hot water supply side refrigerant circuit includes a hot water supply side heat exchanger 5 as a component. Furthermore, the hot water supply unit 304 is provided with a water supply pump 6 for supplying hot water, which has exchanged heat with the refrigerant in the hot water supply side heat exchanger 5, to the boiler or the like.

The hot water supply side heat exchanger 5 may be, for example, a plate heat exchanger. In the hot water supply operation mode executed by the hot water supply unit 304, the hot water supply side heat exchanger 5 functions as a refrigerant condenser to heat water supplied by the water supply pump 6. The water supply pump 6 has functions of supplying water in the boiler into the hot water supply unit 304 to allow the hot water supply side heat exchanger 5 to exchange heat with the water, and then supplying the resultant water as hot water to the boiler. In other words, the hot water supply unit 304 enables to exchange heat between the water supplied by the water supply pump 6 and the refrigerant flowing through the hot water supply side heat exchanger 5. Furthermore, the water supply pump 6 includes a component capable of changing the flow rate of water supplied to the hot water supply side heat exchanger 5.

The hot water supply unit 304 further includes the following various sensors: a hot water supply gas temperature sensor 203, disposed on the gas side of the hot water supply side heat exchanger 5, for detecting the temperature of a gas refrigerant; a hot water supply liquid temperature sensor 204, disposed on the liquid side of the hot water supply side heat exchanger 5, for detecting the temperature of a liquid refrigerant; a water inlet temperature sensor 205, disposed on the water inlet side of the hot water supply unit 304, for detecting the temperature of water flowing into the unit; and a water outlet temperature sensor 206, disposed on the water outlet side of the hot water supply unit 304, for detecting the temperature of water flowing out of the unit.

Furthermore, an operation of the water supply pump 6 is controlled by the control section 103 which executes a normal operation including the hot water supply operation mode of the hot water supply unit 304 (refer to FIG. 2).

<Heat Source Unit 301>

The heat source unit 301 is installed in, for example, an outdoor location. The heat source unit 301 is connected to the use unit 303 through the liquid extension pipe 9, the gas extension pipe 12, and the branch unit 302 and is connected to the hot water supply unit 304 through the hot water supply extension pipe 3, the hot water supply gas pipe 4, and the branch unit 302, and constitutes part of the refrigerant circuit in the air-conditioning and hot water supply combination system 100.

The heat source unit 301 includes an outdoor side refrigerant circuit constituting part of the refrigerant circuit. This outdoor side refrigerant circuit includes, as components, a compressor 1 compressing the refrigerant, the four-way valve 11 for switching between flow directions of the refrigerant, an outdoor heat exchanger 20 serving as a heat source side heat exchanger, three solenoid valves (a first solenoid valve 2, a second solenoid valve 10, a third solenoid valve 27) controlling the flow direction of the refrigerant in accordance with an operation mode, and an accumulator 22 for storing an excess refrigerant. The heat source unit 301 further includes an outdoor air-sending device 21 for supplying air to the outdoor heat exchanger 20, a subcooling heat exchanger 18 for controlling the flow rate of the refrigerant, an outdoor pressure reducing mechanism (heat source side pressure reducing mechanism) 19 for controlling the flow rate of separate refrigerant, a low-pressure bypass pressure reducing mechanism 23, and a suction pressure reducing mechanism 25.

The low-pressure bypass pressure reducing mechanism 23 is disposed in a bypass (low-pressure bypass pipe 24) which connects a point between the branch unit 302 and the subcooling heat exchanger 18 to an inlet of the accumulator 22 through the subcooling heat exchanger 18. Furthermore, the suction pressure reducing mechanism 25 is disposed in a second bypass (suction bypass pipe 26) which connects a point between the subcooling heat exchanger 18 (or a receiver 28 in Embodiment 2) and the outdoor pressure reducing mechanism 19 to suction part of the compressor 1.

The compressor 1 is configured to suck a refrigerant and compress the refrigerant to a high-temperature, high-pressure state. The compressor 1 installed in the air-conditioning and hot water supply combination system 100 is capable of changing the operating capacity and may be, for example, a positive displacement compressor driven by an inverter-controlled motor (not illustrated). In Embodiment 1, the case where the single compressor 1 is provided is illustrated. The arrangement is not limited to this case. Two or more compressors 1 may be arranged in parallel in accordance with the number of connected use units 303. In addition, a discharge pipe connected to the compressor 1 branches into two pipes such that one pipe is connected through the four-way valve 11 to the gas extension pipe 12 and the other pipe is connected to the hot water supply extension pipe 3.

The four-way valve 11 has functions of a flow switching device that switches between flow directions of the refrigerant in accordance with an operation mode of the heat source unit 301. FIG. 3 illustrates the details of operations of the four-way valve 11 in the operation modes. The words of "solid lines" and "broken lines" written in FIG. 3 correspond to "solid lines" and "broken lines" indicating switching states in the four-way valve 11 illustrated in FIG. 1.

In the heating only operation mode or the heating main operation mode, the four-way valve 11 is permitted to switch between flow directions as illustrated by "solid lines". Specifically, in the heating only operation mode or the heating main operation mode, in order to permit the outdoor heat exchanger 20 to function as a refrigerant evaporator, the four-way valve 11 is permitted to switch between flow directions so as to connect the discharge side of the compressor 1 to the gas side of the indoor heat exchanger 14 and further connect the suction side of the compressor 1 to the gas side of the outdoor heat exchanger 20. In the cooling only operation mode or the cooling main operation mode, the four-way valve 11 is permitted to switch between flow directions as illustrated by "broken lines". Specifically, in the cooling only operation mode or the cooling main operation mode, in order to permit the outdoor heat exchanger 20 to function as a refrigerant condenser, the four-way valve 11 is permitted to switch between flow directions so as to connect the discharge side of the compressor 1 to the gas side of the outdoor heat exchanger 20 and further connect the suction side of the compressor 1 to the gas side of the indoor heat exchanger 14.

FIG. 3 further illustrates the details of operations of the solenoid valves in the operation modes. The first solenoid valve 2, which is disposed on the discharge side of the compressor 1 leading to the hot water supply extension pipe 3, has a function of controlling the flow of the refrigerant in accordance with an operation mode of the hot water supply unit 304. In the case where the hot water supply operation is executed, the first solenoid valve 2 is opened. In the case where the hot water supply operation is not executed, it is closed. The second solenoid valve 10, which is disposed on the discharge side of the compressor 1 leading to the four-way valve 11, has a function of controlling the flow of the refrigerant in accordance with an operation mode of the heat source unit 301. In the heating only operation mode, the cooling only operation mode, or the cooling main operation mode, the second solenoid valve 10 is opened. In the heating main operation mode, it is closed. The third solenoid valve 27, which is disposed in a pipe connecting the inlet side of the accumulator 22 to the gas extension pipe 12, has a function of controlling the flow of the refrigerant in accordance with an operation mode of the heat source unit 301. In the heating main operation mode, the third solenoid valve 27 is opened. In the heating only operation mode, the cooling main operation mode, or the cooling only operation mode, it is closed.

The outdoor heat exchanger 20 may be, for example, a cross-fin type fin-and-tube heat exchanger including a heat transfer tube and many fins. Alternatively, the outdoor heat exchanger 20 may be, for example, a microchannel heat exchanger, a shell and tube heat exchanger, a heat pipe heat exchanger, or a double pipe heat exchanger. In the case where the operation mode executed by the air-conditioning and hot water supply combination system 100 is a heating operation mode, the outdoor heat exchanger 20 functions as a refrigerant evaporator to cool the refrigerant. In the cooling operation mode, the outdoor heat exchanger 20 functions as a refrigerant condenser (or radiator) to heat the refrigerant. Furthermore, the gas side of the outdoor heat exchanger 20 is connected to the four-way valve 11 and the liquid side thereof is connected to the outdoor pressure reducing mechanism 19.

The outdoor air-sending device 21 has functions of sucking outdoor air into the heat source unit 301 to allow the outdoor heat exchanger 20 to exchange heat with the outdoor air, and then discharging the resultant air. In other words, the heat source unit 301 enables to exchange heat between the outdoor air taken in by the outdoor air-sending device 21 and the refrigerant flowing through the outdoor heat exchanger 20. The outdoor air-sending device 21 includes a component capable of changing the flow rate of the outdoor air supplied to the outdoor heat exchanger 20. For example, the outdoor air-sending device 21 includes a fan, such as a propeller fan, and a motor, such as a DC fan motor, for driving the fan.

The accumulator 22, disposed on the suction side of the compressor 1, has a function of storing the liquid refrigerant upon occurrence of an abnormal condition in the air-conditioning and hot water supply combination system 100 or upon operation-state transient response, which accompanies a change of operation control, in order to prevent liquid back into the compressor 1.

The subcooling heat exchanger 18 has functions of exchanging heat between the refrigerant flowing through the liquid extension pipe 9 and the refrigerant flowing through the low-pressure bypass pipe 24 and controlling the flow rate of the refrigerant. The outdoor pressure reducing mechanism 19 is disposed between the outdoor heat exchanger 20 and the part, through which the liquid extension pipe 9 extends, of the subcooling heat exchanger 18 and has functions of a pressure reducing valve and an expansion valve and is configured to depressurize the refrigerant in order to expand it. This outdoor pressure reducing mechanism 19 may be a component having a variably controllable opening degree, for example, precise flow control means, such as an electronic expansion valve, or inexpensive refrigerant flow control means, such as a capillary tube.

The low-pressure bypass pressure reducing mechanism 23, which is disposed in the low-pressure bypass pipe 24, has functions as a pressure reducing valve and an expansion valve and is configured to depressurize the refrigerant flowing through the low-pressure bypass pipe 24 in order to expand it. This low-pressure bypass pressure reducing mechanism 23 may be a component having a variably controllable opening degree, for example, precise flow control means, such as an electronic expansion valve, or inexpensive refrigerant flow control means, such as a capillary tube. The suction pressure reducing mechanism 25, which is disposed in the suction bypass pipe 26, has functions as a pressure reducing valve and an expansion valve and is configured to depressurize the refrigerant flowing through the suction bypass pipe 26 in order to expand it. This suction pressure reducing mechanism 25 may be a component having a variably controllable opening degree, for example, precise flow control means, such as an electronic expansion valve, or inexpensive refrigerant flow control means, such as a capillary tube.

The heat source unit 301 further includes the following various sensors. The heat source unit 301 has a discharge pressure sensor 201 (high-pressure detecting device), disposed on the discharge side of the compressor 1, for detecting a discharge pressure; a medium-pressure liquid temperature sensor 210, disposed between the subcooling heat exchanger 18 and the branch unit 302, for detecting the temperature of a liquid refrigerant on the medium-pressure side; a medium pressure sensor 211 (medium pressure detecting device), disposed between the high-pressure side of the subcooling heat exchanger 18 and the outdoor pressure reducing mechanism 19, for detecting a medium pressure; an outdoor liquid temperature sensor 212, disposed on the liquid side of the outdoor heat exchanger 20, for detecting the temperature of a liquid refrigerant; and an outdoor gas temperature sensor 213, disposed on the gas side of the outdoor heat exchanger 20, for detecting the temperature of a gas refrigerant.

The heat source unit 301 further includes an outside air temperature sensor 214, disposed on the outside air suction inlet side of the heat source unit 301, for detecting the temperature of outside air flowing into the unit, a low-pressure liquid temperature sensor 215, disposed on the low-pressure upstream side of the subcooling heat exchanger 18 (the low-pressure bypass pipe 24 between the low-pressure bypass pressure reducing mechanism 23 and the subcooling heat exchanger 18), for detecting a saturation temperature on the low-pressure side, a low-pressure gas temperature sensor 216, disposed in the low-pressure bypass pipe 24 on the low-pressure downstream side of the subcooling heat exchanger 18, for detecting the temperature of a gas refrigerant on the low-pressure side, and a suction pressure sensor 217 (low pressure detecting device), disposed on the suction side of the compressor 1, for detecting a suction pressure.

Note that operations of the compressor 1, the four-way valve 11, the outdoor air-sending device 21, the outdoor pressure reducing mechanism 19, the low-pressure bypass pressure reducing mechanism 23, the suction pressure reducing mechanism 25, the first solenoid valve 2, the second solenoid valve 10, and the third solenoid valve 27 are controlled by the control section 103 for performing a normal operation including the various operation modes (the cooling only operation mode, the cooling main operation mode, the heating only operation mode, the heating main operation mode) of the air-conditioning and hot water supply combination system 100 (refer to FIG. 2).

<Branch Unit 302>

The branch unit 302 is disposed in, for example, an indoor space and is connected to the heat source unit 301 through the liquid extension pipe 9 and the gas extension pipe 12 and is connected to the use unit 303 through the indoor gas pipe 13 and the indoor liquid pipe 16 and is connected to the hot water supply unit 304 through the hot water supply liquid pipe 7, and constitutes part of the refrigerant circuit in the air-conditioning and hot water supply combination system 100. The branch unit 302 has a function of controlling the flow of refrigerant in accordance with operations required in the use unit 303 and the hot water supply unit 304.

The branch unit 302 includes a branch refrigerant circuit constituting part of the refrigerant circuit. This branch refrigerant circuit includes, as components, a hot water supply pressure reducing mechanism 8 for controlling the flow rate of separate refrigerant and an indoor pressure reducing mechanism (use side pressure reducing mechanism) 17 for controlling the flow rate of separate refrigerant.

The hot water supply pressure reducing mechanism 8 is provided on the hot water supply liquid pipe 7 in the branch unit 302. Furthermore, the indoor pressure reducing mechanism 17 is provided on the indoor liquid pipe 16 in the branch unit 302. Each of the hot water supply pressure reducing mechanism 8 and the indoor pressure reducing mechanism 17 has functions as a pressure reducing valve and an expansion valve and is configured to depressurize the refrigerant flowing through the corresponding one of the hot water supply liquid pipe 7 and the indoor liquid pipe 16 in order to expand it. Each of the hot water supply pressure reducing mechanism 8 and the indoor pressure reducing mechanism 17 may be a component having a variably controllable opening degree, for example, precise flow control means, such as an electronic expansion valve, or inexpensive refrigerant flow control means, such as a capillary tube.

Note that an operation of the hot water supply pressure reducing mechanism 8 is controlled by the control section 103 for executing a normal operation including the hot water supply operation mode of the hot water supply unit 304 (refer to FIG. 2). Furthermore, an operation of the indoor pressure reducing mechanism 17 is controlled by the control section 103 for executing a normal operation including the cooling operation mode and the heating operation mode of the use unit 303 (refer to FIG. 2).

Referring to FIG. 2, measurements obtained by the various temperature sensors and the various pressure sensors are input to a measuring section 101 and are then processed by a calculating section 102. The air-conditioning and hot water supply combination system 100 permits the control section 103 to control the compressor 1, the first solenoid valve 2, the water supply pump 6, the hot water supply pressure reducing mechanism 8, the second solenoid valve 10, the four-way valve 11, the indoor air-sending device 15, the indoor pressure reducing mechanism 17, the outdoor pressure reducing mechanism 19, the outdoor air-sending device 21, the low-pressure bypass pressure reducing mechanism 23, the suction pressure reducing mechanism 25, and the third solenoid valve 27 on the basis of the result of processing by the calculating section 102. In other words, the measuring section 101, the calculating section 102, and the control section 103 perform centralized control of operations and actions of the air-conditioning and hot water supply combination system 100. Note that each of these sections may include a microcomputer.

Specifically, the control section 103 controls the driving frequency of the compressor 1, opening and closing of the first solenoid valve 2, the rotation speed (including ON/OFF) of the water supply pump 6, the opening degree of the hot water supply pressure reducing mechanism 8, switching by the four-way valve 11, the rotation speed (including ON/OFF) of the indoor air-sending device 15, the opening degree of the indoor pressure reducing mechanism 17, the opening degree of the outdoor pressure reducing mechanism 19, the rotation speed (including ON/OFF) of the outdoor air-sending device 21, the opening degree of the low-pressure bypass pressure reducing mechanism 23, the opening degree of the suction pressure reducing mechanism 25, and opening and closing of the third solenoid valve 27 on the basis of an instruction supplied from, for example, a remote control and calculations based on information items detected by the various sensors to execute any of the operation modes. Furthermore, the measuring section 101, the calculating section 102, and the control section 103 may be integrated with each other into a single component or may be arranged as discrete components. In addition, the measuring section 101 the calculating section 102, and the control section 103 may be arranged in any of the units. Furthermore, the measuring section 101 the calculating section 102, and the control section 103 may be arranged in each of the units.

[Operations]

The air-conditioning and hot water supply combination system 100 controls devices (actuators) mounted in the heat source unit 301, the branch unit 302, the use unit 303, and the hot water supply unit 304 in accordance with an operating load required in the use unit 303 to execute the heating only operation mode, the heating main operation mode, the cooling only operation mode, or the cooling main operation mode. The operations of the four-way valve and the solenoid valves in the operation modes are as illustrated in FIG. 3.

<Heating Only Operation Mode>

In the heating only operation mode, the four-way valve 11 is controlled so as to be in a state indicated by the solid lines, such that the discharge side of the compressor 1 is connected through the gas extension pipe 12 to the indoor gas pipe 13 and the suction side of the compressor 1 is connected to the outdoor heat exchanger 20. Furthermore, control is performed such that the use unit 303 is in the heating operation mode, the hot water supply unit 304 is in the hot water supply operation mode, the first solenoid valve 2 is opened, the second solenoid valve 10 is opened, and the third solenoid valve 27 is closed.

In the refrigerant circuit in such a state, the compressor 1, the water supply pump 6, the indoor air-sending device 15, and the outdoor air-sending device 21 are activated. Consequently, a low-pressure gas refrigerant is sucked into the compressor 1 in which the refrigerant is compressed into a high-temperature, high-pressure gas refrigerant. After that, the high-temperature, high-pressure gas refrigerant is separated into parts such that the refrigerant flows through the first solenoid valve 2 or the second solenoid valve 10.

The refrigerant, which has flowed into the first solenoid valve 2, passes through the hot water supply extension pipe 3 and the hot water supply gas pipe 4 and then flows into the hot water supply unit 304. The refrigerant flowing into the hot water supply unit 304 flows into the hot water supply side heat exchanger 5 and exchanges heat with the water supplied by the water supply pump 6 such that it is condensed into a high-pressure liquid refrigerant, and then flows out of the hot water supply side heat exchanger 5. The refrigerant, which has heated the water in the hot water supply side heat exchanger 5, passes through the hot water supply liquid pipe 7 and flows into the branch unit 302 and is depressurized by the hot water supply pressure reducing mechanism 8 such that it turns into a medium-pressure, two-phase gas-liquid or liquid-phase refrigerant. After that, the refrigerant merges with the refrigerant flowing through the indoor pressure reducing mechanism 17. The resultant refrigerant flows into the liquid extension pipe 9.

The hot water supply pressure reducing mechanism 8 controls the flow rate of the refrigerant flowing through the hot water supply side heat exchanger 5. The refrigerant flows through the hot water supply side heat exchanger 5 such that the flow rate of the refrigerant depends on a hot water supply load required in the use of hot water in the space where the hot water supply unit 304 is installed. Note that the opening degree of the hot water supply pressure reducing mechanism 8 is controlled by the control section 103 such that the degree of subcooling on the liquid side of the hot water supply side heat exchanger 5 is at a predetermined value. The degree of subcooling on the liquid side of the hot water supply side heat exchanger 5 is obtained by calculating a saturation temperature (condensing temperature) from a pressure detected by the discharge pressure sensor 201 and subtracting a temperature detected by the hot water supply liquid temperature sensor 204 from the saturation temperature.

Whereas, the refrigerant, which has flowed into the second solenoid valve 10, passes through the four-way valve 11 and the gas extension pipe 12 and then flows into the branch unit 302. After that, the refrigerant flows through the indoor gas pipe 13 into the use unit 303. The refrigerant flowing into the use unit 303 flows into the indoor heat exchanger 14, exchanges heat with the indoor air supplied by the indoor air-sending device 15 such that it is condensed into a high-pressure liquid refrigerant, and then flows out of the indoor heat exchanger 14. The refrigerant, which has heated the indoor air in the indoor heat exchanger 14, flows through the indoor liquid pipe 16 into the branch unit 302 and is depressurized by the indoor pressure reducing mechanism 17 such that it turns into a medium-pressure, two-phase gas-liquid or liquid-phase refrigerant. After that, the refrigerant merges with the refrigerant flowing through the hot water supply pressure reducing mechanism 8. The resultant refrigerant flows into the liquid extension pipe 9.

The indoor pressure reducing mechanism 17 controls the flow rate of the refrigerant flowing through the indoor heat exchanger 14. The refrigerant flows through the indoor heat exchanger 14 such that the flow rate of the refrigerant depends on a heating load required in the conditioned area where the use unit 303 is installed. Note that the opening degree of the indoor pressure reducing mechanism 17 is controlled by the control section 103 such that the degree of subcooling on the liquid side of the indoor heat exchanger 14 is at a predetermined value. The degree of subcooling on the liquid side of the indoor heat exchanger 14 is obtained by calculating a saturation temperature (condensing temperature) from a pressure detected by the discharge pressure sensor 201 and subtracting a temperature detected by the indoor liquid temperature sensor 208 from the saturation temperature.

The refrigerant, which has flowed into the liquid extension pipe 9, flows out of the branch unit 302 and flows into the heat source unit 301. The refrigerant flowing into the heat source unit 301 is separated into part flowing into the low-pressure bypass pipe 24 and part flowing into the high-pressure side of the subcooling heat exchanger 18.

The refrigerant, which has flowed into the high-pressure side of the subcooling heat exchanger 18, is cooled by the refrigerant flowing through the low-pressure side (namely, the low-pressure bypass pipe 24) and is then separated into part flowing into the suction bypass pipe 26 and part flowing into the outdoor pressure reducing mechanism 19. The refrigerant, which has flowed into the outdoor pressure reducing mechanism 19, is depressurized to a low pressure and then flows into the outdoor heat exchanger 20, in which the refrigerant exchanges heat with the outside air supplied by the outdoor air-sending device 21 such that it is evaporated into a low-pressure gas refrigerant. This refrigerant flows out of the outdoor heat exchanger 20, passes through the four-way valve 11, and merges with the refrigerant flowing through the low-pressure bypass pipe 24. The resultant refrigerant flows into the accumulator 22.

Note that the opening degree of the outdoor pressure reducing mechanism 19 is controlled by the control section 103 such that the difference between the medium pressure and the low pressure is at a predetermined value. The difference between the medium pressure and the low pressure is obtained by subtracting a pressure detected by the suction pressure sensor 217 from a pressure detected by the medium pressure sensor 211. The opening degree of the outdoor pressure reducing mechanism 19 is controlled such that the difference between the medium pressure and the low pressure is at the predetermined value and the flow rate of the refrigerant flowing through the outdoor pressure reducing mechanism 19 is controlled, thus providing a state in which the difference between the medium pressure and the low pressure has the predetermined value. Upon switching to the heating main operation mode, such control can reduce the time to control the refrigerant flowing into the use unit 303 such that the flow rate of the refrigerant depends on a cooling load required in the conditioned space.

Whereas, the refrigerant, which has flowed into the low-pressure bypass pipe 24, is depressurized by the low-pressure bypass pressure reducing mechanism 23. After that, the refrigerant is heated on the low-pressure side of the subcooling heat exchanger 18 by the refrigerant flowing through the high-pressure side and then merges with the refrigerant which has passed through the four-way valve 11. After that, the resultant refrigerant flows into the accumulator 22.

At this time, the opening degree of the low-pressure bypass pressure reducing mechanism 23 is controlled by the control section 103 such that the degree of superheat of the refrigerant on the low-pressure gas side of the subcooling heat exchanger 18 is at a predetermined value. The degree of superheat of the refrigerant on the low-pressure gas side of the subcooling heat exchanger 18 is obtained by subtracting a temperature detected by the low-pressure liquid temperature sensor 215 from a temperature detected by the low-pressure gas temperature sensor 216.

Whereas, the refrigerant, which has flowed into the suction bypass pipe 26, is depressurized by the suction pressure reducing mechanism 25 and then merges with the refrigerant flowing out of the accumulator 22. At this time, the opening degree of the suction pressure reducing mechanism 25 is controlled by the control section 103 such that it is fully closed upon normal operation.

The refrigerant, which has flowed into the accumulator 22, then merges with the refrigerant flowing through the suction bypass pipe 26. The resultant refrigerant is again sucked into the compressor 1.

Note that the control section 103 controls the compressor 1 in accordance with a heating load required in the use unit 303 and a hot water supply load required in the hot water supply unit 304 such that the condensing temperature is at a predetermined value. Furthermore, the control section 103 controls the outdoor air-sending device 21 in accordance with an outside air temperature detected by the outside air temperature sensor 214 such that the evaporating temperature is at a predetermined value. In this case, the condensing temperature is the saturation temperature calculated from a pressure detected by the discharge pressure sensor 201 and the evaporating temperature is a saturation temperature calculated from a pressure detected by the suction pressure sensor 217.

In the heating only operation mode, in the case where hot water supply at high temperature (for example, 60 degrees C.) is performed when the outside air temperature is high, an increase in pressure on the low-pressure side and an increase in pressure on the high-pressure side occur. In the case where no liquid refrigerant is stored in the accumulator 22, an increase in discharge temperature further occurs. In the air-conditioning and hot water supply combination system 100, the following controls are executed in order to avoid such operation states, thus providing a high hot water supply capacity.

FIG. 4 includes schematic explanatory diagrams explaining control for avoiding an increase in pressure on the low-pressure side, control for avoiding an increase in discharge temperature, and control for avoiding an increase in pressure on the high-pressure side, the controls being performed under high-temperature outside air conditions by the air-conditioning and hot water supply combination system 100. FIG. 4(*a*) schematically illustrates a change in operation state during execution of the control for avoiding an increase in pressure on the low-pressure side, FIG. 4(*b*) schematically illustrates a change in operation state during execution of the control for avoiding an increase in discharge temperature, and FIG. 4(*c*) schematically illustrates a change in operation state during execution of the control for avoiding an increase in pressure on the high-pressure side, the controls being performed under high-temperature outside air conditions by the air-conditioning and hot water supply combination system 100. In FIG. 4, broken lines each indicate a change in state before control and solid lines each indicate a change in state after control.

Referring to FIG. 4(*a*), in the case where a pressure on the low-pressure side increases to a predetermined value or higher (at or above a first predetermined value), the opening degree of the low-pressure bypass pressure reducing mechanism 23 is set to be greater than a predetermined value in order to bypass the liquid refrigerant, thus reducing the flow rate of the refrigerant flowing through the outdoor heat exchanger 20. At the inlet of the accumulator 22, the refrigerant is a saturated gas. As the liquid refrigerant flowing into the low-pressure bypass pipe 24 increases in flow rate, therefore, the degree of superheat (SH) of the refrigerant on the gas side of the outdoor heat exchanger 20 becomes higher. The higher the degree of superheat of the outdoor heat exchanger 20, the more the gas refrigerant in the outdoor heat exchanger 20. Thus, a pressure on the low-pressure side can be reduced.

Furthermore, normal operation control by the control section 103 controls the opening degree of the hot water supply pressure reducing mechanism 8, thus allowing the refrigerant on the liquid side of the hot water supply side heat exchanger 5 to be a subcooled liquid. Furthermore, controlling the opening degree of the indoor pressure reducing mechanism 17 allows the refrigerant on the liquid side of the indoor heat exchanger 14 to be a subcooled liquid. Accordingly, the liquid refrigerant is secured at the inlet of the low-pressure bypass pressure reducing mechanism 23. Setting the opening degree of the low-pressure bypass pressure reducing mechanism 23 to be greater than the predetermined value enables the liquid refrigerant to flow to the inlet of the accumulator 22.

FIG. 5(*a*) illustrates the relationship between the degree of superheat on the gas side of the outdoor heat exchanger 20 and the evaporating temperature ET. Specifically, a target value $SHm_{OC}$ [degree C] of the degree of superheat on the gas side of the outdoor heat exchanger 20 is set by the following Equation (1).

[Math. 1]

$$SHm_{OC}=T_{OCai}-ET_{max} \quad (1)$$

In this equation, $T_{OCai}$ denotes an outside air temperature [degree C] and $ET_{max}$ denotes an evaporating temperature upper limit [degree C]. The sum of $ET_{max}$ and $SHm_{OC}$ is a temperature on the gas side of the outdoor heat exchanger 20. The temperature on the gas side of the outdoor heat exchanger 20 is less than or equal to the outside air temperature $T_{OCai}$. Accordingly, setting the target value $SHm_{OC}$ of the degree of superheat on the gas side of the outdoor heat exchanger 20 in Equation (1) can reduce the evaporating temperature to $ET_{max}$ or lower.

Referring to FIG. 4(*b*), in the case where the discharge temperature increases to 110 degrees C. or higher (at or above a fourth predetermined value) under high-temperature outside air conditions, the degree of superheat on the gas side of the outdoor heat exchanger 20 increases, for example, to 2 degrees C. or higher (a third predetermined value or higher), so that the degree of suction superheat of the compressor 1 increases. In this case, therefore, setting the opening degree of the low-pressure bypass pressure reducing mechanism 23 to be greater than a predetermined value permits the liquid refrigerant to flow to the low-pressure side such that the gas refrigerant flowing through the gas side of the outdoor heat exchanger 20 is cooled to reduce the degree of superheat on the gas side of the outdoor heat exchanger 20. Thus, the degree of suction superheat of the compressor can be reduced. Accordingly, the discharge temperature of the compressor 1 can be reduced to 110 degrees C. or lower.

As described above, in the air-conditioning and hot water supply combination system 100, the low-pressure bypass pressure reducing mechanism 23 controls the quantity of liquid refrigerant flowing through the low-pressure bypass pipe 24 to control the degree of superheat on the gas side of the outdoor heat exchanger 20, so that an increase in pressure on the low-pressure side and an increase in discharge temperature can be avoided. The air-conditioning and hot water supply combination system 100 can, therefore, provide a high hot water supply capacity even under high-temperature outside air conditions.

Referring to FIG. 4(*c*), in the case where a pressure on the high-pressure side increases, setting the opening degree of the hot water supply pressure reducing mechanism 8 to be greater than a predetermined value reduces the degree of subcooling on the liquid side of the hot water supply side heat exchanger 5. In other words, setting the opening degree of the hot water supply pressure reducing mechanism 8 to be greater than the predetermined value allows the refrigerant to move to the low-pressure side, so that an increase in pressure on the high-pressure side can be avoided.

FIG. 5(*b*) illustrates the relationship between the degree of subcooling on the liquid side of the hot water supply side heat exchanger 5, the condensing temperature CT, and the operation efficiency. Specifically, a target value $SCm_W$ [degree C] of the degree of subcooling on the liquid side of the hot water supply side heat exchanger 5 is set by the following Equations (2) and (3).

[Math. 2]

$$SCm_w = \varepsilon \times (CT - T_{wi}) \quad (2)$$

[Math. 3]

$$\varepsilon = \frac{CT_{opt} - T_{scow,opt}}{CT_{opt} - T_{wimax,opt}} \quad (3)$$

In the equations, $CT_{opt}$ denotes the condensing temperature [degree C] at the highest operation efficiency, $T_{wimax,opt}$ denotes the inlet temperature [degree C] of water flowing into the hot water supply side heat exchanger 5 at the highest hot water supply temperature, $T_{scow,opt}$ denotes the temperature [degree C] on the liquid side of the hot water supply side heat exchanger 5 at $CT_{opt}$, and c denotes the liquid-phase-based temperature efficiency ratio [–]. The higher the liquid-phase-based temperature efficiency ratio $\epsilon$, the larger the quantity of liquid refrigerant in the hot water supply side heat exchanger 5. This means that a large quantity of refrigerant exists on the high-pressure side.

$CT_{opt}$, $T_{SCOw,opt}$, and $T_{wimax,opt}$ are obtained by examinations and simulations and $\epsilon$ is then calculated. In other words, $\epsilon$ is a value previously set in the device and is derived in the following manner, for example. A hot water supply temperature is set to the highest hot water supply temperature (60 degrees C. in the case where the highest hot water supply temperature is 60 degrees C.) of the device, and the degree of subcooling on the liquid side of the hot water supply side heat exchanger 5 is controlled by the hot water supply pressure reducing mechanism 8. The degree of subcooling on the liquid side of the hot water supply side heat exchanger 5 at the highest operation efficiency is obtained. At this time, the condensing temperature is $CT_{opt}$, the temperature on the liquid side of the hot water supply side heat exchanger 5 is $T_{scow, opt}$, and the inlet temperature of water flowing into the hot water supply side heat exchanger 5 at the highest hot water supply temperature is $T_{wimax, opt}$. Controlling the hot water supply pressure reducing mechanism 8 such that a condensing pressure is less than or equal to $CT_{opt}$ (a second predetermined value) can avoid a reduction in operation efficiency as illustrated in FIG. 5(*b*).

In addition, the hot water supply pressure reducing mechanism 8 is controlled such that the degree of subcooling on the liquid side of the hot water supply side heat exchanger 5 is the target value $SCm_W$ of the degree of subcooling given by the above-described Equation (2), so that an increase in pressure on the high-pressure side can be avoided. Thus, the optimum operation efficiency can be achieved.

In the case where the hot water supply operation is performed under low-temperature outside air conditions where the outside air temperature is low, a pressure on the low-pressure side decreases and the discharge temperature increases. For example, in the case where the discharge temperature is greater than or equal to 110 degrees C (a sixth predetermined value) and the reliability of the device is therefore reduced, the opening degree of the suction pressure reducing mechanism 25 is set to be greater than a predetermined value such that the liquid refrigerant flows into the suction part of the compressor 1 in order to cool the refrigerant in the discharge part, so that the discharge temperature can be set to be less than or equal to 110 degrees C (the sixth predetermined value). Thus, a high hot water supply capacity can be achieved even under low-temperature outside air conditions.

<Heating Main Operation Mode>

In the heating main operation mode, the four-way valve 11 is controlled so as to be in a state indicated by the solid lines, such that the discharge side of the compressor 1 is connected through the gas extension pipe 12 to the indoor gas pipe 13 and the suction side of the compressor 1 is connected to the outdoor heat exchanger 20. Furthermore, control is performed such that the use unit 303 is in the cooling operation mode, the hot water supply unit 304 is in the hot water supply operation mode, the first solenoid valve 2 is opened, the second solenoid valve 10 is closed, and the third solenoid valve 27 is opened.

In the refrigerant circuit in such a state, the compressor 1, the water supply pump 6, the indoor air-sending device 15, and the outdoor air-sending device 21 are activated. Consequently, a low-pressure gas refrigerant is sucked into the compressor 1 in which the refrigerant is compressed into a high-temperature, high-pressure gas refrigerant. After that, the high-temperature, high-pressure gas refrigerant flows through the first solenoid valve 2.

The refrigerant, which has flowed into the first solenoid valve 2, passes through the hot water supply extension pipe 3 and the hot water supply gas pipe 4 and then flows into the hot water supply unit 304. The refrigerant flowing into the hot water supply unit 304 flows into the hot water supply side heat exchanger 5 and exchanges heat with the water supplied by the water supply pump 6 such that it is condensed into a high-pressure liquid refrigerant, and then flows out of the hot water supply side heat exchanger 5. The refrigerant, which has heated the water in the hot water supply side heat exchanger 5, flows through the hot water supply liquid pipe 7 into the branch unit 302 and is depressurized by the hot water supply pressure reducing mechanism 8 such that it turns into a medium-pressure, two-phase gas-liquid or liquid-phase refrigerant. After that, the refrigerant is separated into part flowing into the liquid extension pipe 9 and part flowing into the indoor pressure reducing mechanism 17.

The hot water supply pressure reducing mechanism 8 controls the flow rate of the refrigerant flowing through the hot water supply side heat exchanger 5. The refrigerant flows through the hot water supply side heat exchanger 5 such that the flow rate of the refrigerant depends on a hot water supply load required in the use of hot water in the space where the hot water supply unit 304 is installed. Note that the opening degree of the hot water supply pressure reducing mechanism 8 is controlled by the control section 103 such that the degree of subcooling on the liquid side of the hot water supply side heat exchanger 5 is at a predetermined value. How to derive the degree of subcooling is as explained in the heating only operation mode.

The refrigerant, which has flowed into the indoor pressure reducing mechanism 17, is depressurized by the indoor pressure reducing mechanism 17 such that it turns into a low-pressure, two-phase gas-liquid state, and then flows through the indoor liquid pipe 16 into the use unit 303. The refrigerant flowing into the use unit 303 flows into the indoor heat exchanger 14 and exchanges heat with the indoor air supplied by the indoor air-sending device 15 such that it is evaporated into a low-pressure gas refrigerant. At this time, the opening degree of the indoor pressure reducing mechanism 17 is controlled by the control section 103 such that the degree of superheat of the refrigerant on the gas side of the indoor heat exchanger 14 is at a predetermined value. The degree of superheat of the refrigerant on the gas side of the indoor heat exchanger 14 is derived by subtracting a temperature detected by the indoor liquid temperature sensor 208 from a temperature detected by the indoor gas temperature sensor 207.

Since the indoor pressure reducing mechanism 17 controls the flow rate of the refrigerant flowing through the indoor heat exchanger 14 such that the degree of superheat of the refrigerant on the gas side of the indoor heat exchanger 14 is at the predetermined value, the low-pressure gas refrigerant obtained by evaporation in the indoor heat exchanger 14 is allowed to have the predetermined degree of superheat. As described above, the refrigerant flows through the indoor heat exchanger 14 such that the flow rate of the refrigerant depends on a cooling load required in the conditioned space in which the use unit 303 is installed.

The refrigerant, which has flowed out of the indoor heat exchanger 14, passes through the indoor gas pipe 13 and the branch unit 302 and then flows through the gas extension pipe 12 and the third solenoid valve 27. This refrigerant merges with the refrigerant which has passed through the four-way valve 11.

Whereas, the refrigerant, which has flowed into the liquid extension pipe 9, flows out of the branch unit 302 and flows into the heat source unit 301. The refrigerant flowing into the heat source unit 301 is separated into part flowing into the low-pressure bypass pipe 24 and part flowing into the high-pressure side of the subcooling heat exchanger 18.

The refrigerant, which has flowed into the high-pressure side of the subcooling heat exchanger 18, is cooled by the refrigerant flowing through the low-pressure side (namely, the low-pressure bypass pipe 24) and is then separated into part flowing into the suction bypass pipe 26 and part flowing into the outdoor pressure reducing mechanism 19. The refrigerant, which has flowed into the outdoor pressure reducing mechanism 19, is depressurized to a low pressure and then flows into the outdoor heat exchanger 20 and exchanges heat with the outside air supplied by the outdoor air-sending device 21 such that it is evaporated into a low-pressure gas refrigerant. This refrigerant flows out of the outdoor heat exchanger 20, passes through the four-way valve 11, and merges with the refrigerant which has passed through the third solenoid valve 27 and the refrigerant which has flowed through the low-pressure bypass pipe 24. The resultant refrigerant flows into the accumulator 22.

At this time, the opening degree of the outdoor pressure reducing mechanism 19 is controlled by the control section 103 such that the difference between the medium pressure and the low pressure is at a predetermined value. How to derive the difference between the medium pressure and the low pressure is as explained in the heating only operation mode. The opening degree of the outdoor pressure reducing mechanism 19 is controlled such that the difference between the medium pressure and the low pressure is at the predetermined value and the flow rate of the refrigerant flowing through the outdoor pressure reducing mechanism 19 is controlled, thus providing a state in which the difference between the medium pressure and the low pressure has the predetermined value. Such control permits the refrigerant to flow into the use unit 303 such that the flow rate of the refrigerant depends on a cooling load required in the conditioned space.

Whereas, the refrigerant, which has flowed into the low-pressure bypass pipe 24, is depressurized by the low-pressure bypass pressure reducing mechanism 23. After that, the refrigerant is heated on the low-pressure side of the subcooling heat exchanger 18 by the refrigerant flowing through the high-pressure side and then merges with the refrigerant which has passed through the four-way valve 11. After that, the resultant refrigerant flows into the accumulator 22.

At this time, the opening degree of the low-pressure bypass pressure reducing mechanism 23 is controlled by the control section 103 such that the degree of superheat of the refrigerant on the low-pressure gas side of the subcooling heat exchanger 18 is at a predetermined value. How to derive the degree of superheat of the refrigerant on the low-pressure gas side of the subcooling heat exchanger 18 is as explained in the heating only operation mode.

Whereas, the refrigerant, which has flowed into the suction bypass pipe 26, is depressurized by the suction pressure reducing mechanism 25 and then merges with the refrigerant which has flowed out of the accumulator 22. At this time, the opening degree of the suction pressure reducing mechanism 25 is controlled by the control section 103 such that it is fully closed upon normal operation.

The refrigerant, which has flowed into the accumulator 22, then merges with the refrigerant flowing through the suction bypass pipe 26. The resultant refrigerant is again sucked into the compressor 1.

Note that the control section 103 controls the compressor 1 in accordance with a hot water supply load required in the hot water supply unit 304 such that the condensing temperature is at a predetermined value. Furthermore, the control section 103 controls the outdoor air-sending device 21 in accordance with a cooling load required in the use unit 303 such that the evaporating temperature is at a predetermined value.

In the air-conditioning and hot water supply combination system 100, in the case where high-temperature hot water supply (for example, hot water supply at 60 degrees C.) is performed in the heating main operation mode when the outside air temperature is high, the low-pressure bypass pressure reducing mechanism 23 controls the quantity of liquid refrigerant flowing through the low-pressure bypass pipe 24 in the same way as in the heating only operation mode, thereby controlling the degree of superheat on the gas side of the outdoor heat exchanger 15. Thus, an increase in pressure on the low-pressure side and an increase in discharge temperature can be avoided. In addition, controlling the degree of subcooling on the liquid side of the hot water supply side heat exchanger 5 can avoid an increase in pressure on the high-pressure side and achieve a highly efficient operation state.

Furthermore, in the heating main operation mode, in the case where the difference between an outside air temperature detected by the outside air temperature sensor 214 and an evaporating temperature is less than or equal to a predetermined value (at or below a fifth predetermined value) (for example, when it is less than or equal to 2 degrees C.), there is hardly any difference in temperature between the refrigerant and the air in the outdoor heat exchanger 20. The quantity of heat removed from the outside air by the refrigerant is small. In such an operation state, the opening degree of the outdoor pressure reducing mechanism 19 is less than a predetermined value. Alternatively, the outdoor pressure reducing mechanism 19 is fully closed such that the indoor heat exchanger 14 performs an exhaust heat full recovery operation, thus achieving a highly efficient operation state.

Furthermore, if the discharge temperature increases in the case where the hot water supply operation is performed under low-temperature outside air conditions where the outside air temperature is low, the opening degree of the suction pressure reducing mechanism 25 is set to be greater than a predetermined value in the same way as in the heating only operation mode, so that an increase in discharge temperature can be avoided.

<Cooling Only Operation Mode>

In the cooling only operation mode, the four-way valve 11 is controlled so as to be in a state indicated by the broken lines, such that the discharge side of the compressor 1 is connected to the outdoor heat exchanger 20 and the suction side of the compressor 1 is connected through the gas extension pipe 12 to the indoor gas pipe 13. Furthermore, control is performed such that the use unit 303 is in the cooling operation mode, the hot water supply unit 304 does not perform the hot water supply operation, the first solenoid valve 2 is closed, the second solenoid valve 10 is opened, and the third solenoid valve 27 is closed.

In the refrigerant circuit in such a state, the compressor 1, the indoor air-sending device 15, and the outdoor air-sending device 21 are activated. Consequently, a low-pressure gas refrigerant is sucked into the compressor 1, in which the refrigerant is compressed into a high-temperature, high-pressure gas refrigerant. After that, the high-temperature, high-pressure gas refrigerant flows through the second solenoid valve 10. Since the hot water supply unit 304 does not perform the hot water supply operation, the water supply pump 6 is controlled so as to be in a stopped state.

The refrigerant, which has flowed into the second solenoid valve 10, flows through the four-way valve 11 into the outdoor heat exchanger 20 and exchanges heat with the outside air supplied by the outdoor air-sending device 21 such that it is condensed into a high-pressure liquid refrigerant. This high-pressure liquid refrigerant flows through the outdoor pressure reducing mechanism 19 whose opening degree is fully opened and is then separated into part flowing into the high-pressure side of the subcooling heat exchanger 18 and part flowing into the suction bypass pipe 26. The refrigerant, which has flowed into the high-pressure side of the subcooling heat exchanger 18, is cooled by the refrigerant flowing through the low-pressure side, flows out of the subcooling heat exchanger 18, and is then separated into part flowing into the liquid extension pipe 9 and part flowing into the low-pressure bypass pipe 24.

The refrigerant, which has flowed into the liquid extension pipe 9, flows into the branch unit 302, passes through the indoor liquid pipe 16, and is depressurized by the indoor pressure reducing mechanism 17 such that it turns into a low-pressure two-phase gas-liquid state. The refrigerant flows out of the branch unit 302 and flows into the use unit 303. The refrigerant, which has flowed into the use unit 303, flows into the indoor heat exchanger 14 and exchanges heat with the indoor air supplied by the indoor air-sending device 15 such that it is evaporated into a low-pressure gas refrigerant. At this time, the opening degree of the indoor pressure reducing mechanism 17 is controlled by the control section 103 such that the degree of superheat of the refrigerant on the gas side of the indoor heat exchanger 14 is at a predetermined value. How to derive the degree of superheat is as explained in the heating only operation mode. Note that the hot water supply pressure reducing mechanism 8 is controlled so as to be fully closed.

Since the indoor pressure reducing mechanism 17 controls the flow rate of the refrigerant flowing through the indoor heat exchanger 14 such that the degree of superheat of the refrigerant on the gas side of the indoor heat exchanger 14 is at the predetermined value, the low-pressure gas refrigerant obtained by evaporation in the indoor heat exchanger 14 is allowed to have the predetermined degree of superheat. As described above, the refrigerant flows through the indoor heat exchanger 14 such that the flow rate of the refrigerant depends on a cooling load required in the conditioned space in which the use unit 303 is installed.

The refrigerant, which has flowed out of the indoor heat exchanger 14, passes through the indoor gas pipe 13 and the branch unit 302, flows through the gas extension pipe 12, passes through the four-way valve 11, and then merges with the refrigerant flowing through the low-pressure bypass pipe 24.

Whereas, the refrigerant, which has flowed into the low-pressure bypass pipe 24, is depressurized by the low-pressure bypass pressure reducing mechanism 23. After that, the refrigerant is heated on the low-pressure side of the subcooling heat exchanger 18 by the refrigerant flowing through the high-pressure side and then merges with the refrigerant which has passed through the four-way valve 11. After that, the resultant refrigerant flows into the accumulator 22.

At this time, the opening degree of the low-pressure bypass pressure reducing mechanism 23 is controlled by the control section 103 such that the degree of subcooling of the refrigerant on the high-pressure liquid side of the subcooling heat exchanger 18 is at a predetermined value. The degree of subcooling of the refrigerant on the high-pressure liquid side of the subcooling heat exchanger 18 is obtained by subtracting a temperature detected by the medium-pressure liquid temperature sensor 210 from a condensing temperature calculated from a pressure detected by the discharge pressure sensor 201.

Whereas, the refrigerant, which has flowed into the suction bypass pipe 26, is depressurized by the suction pressure reducing mechanism 25 and then merges with the refrigerant flowing out of the accumulator 22. At this time, the opening degree of the suction pressure reducing mechanism 25 is controlled by the control section 103 such that it is fully closed upon normal operation.

The refrigerant flowing into the accumulator 22 then merges with the refrigerant flowing through the suction bypass pipe 26. The resultant refrigerant is again sucked into the compressor 1.

Note that the control section 103 controls the compressor 1 in accordance with a cooling load required in the use unit 303 such that the evaporating temperature is at a predetermined value. Furthermore, the control section 103 controls the outdoor air-sending device 21 in accordance with an outside air temperature detected by the outside air temperature sensor 214 such that the condensing temperature is at a predetermined value.

<Cooling Main Operation Mode>

In the cooling main operation mode, the four-way valve 11 is controlled so as to be in a state indicated by the broken lines, such that the discharge side of the compressor 1 is connected to the outdoor heat exchanger 20 and the suction side of the compressor 1 is connected through the gas extension pipe 12 to the indoor gas pipe 13. Furthermore, control is performed such that the use unit 303 is in the cooling operation mode, the hot water supply unit 304 is in the hot water supply operation mode, the first solenoid valve 2 is opened, the second solenoid valve 10 is opened, and the third solenoid valve 27 is closed.

In the refrigerant circuit in such a state, the compressor 1, the water supply pump 6, the indoor air-sending device 15, and the outdoor air-sending device 21 are activated. Consequently, a low-pressure gas refrigerant is sucked into the compressor 1, in which the refrigerant is compressed into a high-temperature, high-pressure gas refrigerant. After that, the high-temperature, high-pressure gas refrigerant is separated into parts such that the refrigerant flows through the first solenoid valve 2 or the second solenoid valve 10.

The refrigerant, which has flowed into the first solenoid valve 2, passes through the hot water supply extension pipe 3 and the hot water supply gas pipe 4 and then flows into the hot water supply unit 304. The refrigerant flowing into the hot water supply unit 304 flows into the hot water supply side heat exchanger 5 and exchanges heat with the water supplied by the water supply pump 6 such that it is condensed into a high-pressure liquid refrigerant, and then flows out of the hot water supply side heat exchanger 5. The refrigerant, which has heated the water in the hot water supply side heat exchanger 5, passes through the hot water supply liquid pipe 7 and flows into the branch unit 302 and is depressurized by the hot water supply pressure reducing mechanism 8 such that it turns into a medium-pressure, two-phase gas-liquid or liquid-phase refrigerant. After that, the refrigerant merges with the refrigerant flowing though the liquid extension pipe 9. The resultant refrigerant flows into the indoor pressure reducing mechanism 17.

The hot water supply pressure reducing mechanism 8 controls the flow rate of the refrigerant flowing through the hot water supply side heat exchanger 5. The refrigerant flows through the hot water supply side heat exchanger 5 such that the flow rate of the refrigerant depends on a hot water supply load required in the use of hot water in the space where the hot water supply unit 304 is installed. Note that the opening degree of the hot water supply pressure reducing mechanism 8 is controlled by the control section 103 such that the degree of subcooling on the liquid side of the hot water supply side heat exchanger 5 is at a predetermined value. How to derive the degree of subcooling is as explained in the heating only operation mode.

Whereas, the refrigerant, which has flowed into the second solenoid valve 10, flows through the four-way valve 11 into the outdoor heat exchanger 20 and exchanges heat with the outside air supplied by the outdoor air-sending device 21 such that it is condensed into a high-pressure liquid refrigerant. This high-pressure liquid refrigerant is depressurized by the outdoor pressure reducing mechanism 19 and is then separated into part flowing into the high-pressure side of the subcooling heat exchanger 18 and part flowing into the suction bypass pipe 26. The refrigerant flowing into the high-pressure side of the subcooling heat exchanger 18 is cooled by the refrigerant flowing through the low-pressure side and flows out of the subcooling heat exchanger 18 and is then separated into part flowing into the liquid extension pipe 9 and part flowing into the low-pressure bypass pipe 24.

At this time, the opening degree of the outdoor pressure reducing mechanism 19 is controlled by the control section 103 such that the degree of subcooling on the liquid side of the outdoor heat exchanger 20 is at a predetermined value. The degree of subcooling on the liquid side of the outdoor heat exchanger 20 is derived by subtracting a temperature detected by the outdoor liquid temperature sensor 212 from a condensing temperature calculated from a pressure detected by the discharge pressure sensor 201.

The refrigerant flowing through the liquid extension pipe 9 flows into the branch unit 302 and then merges with the refrigerant, which has passed through the hot water supply pressure reducing mechanism 8. After that, the resultant refrigerant flows through the indoor liquid pipe 16 and is depressurized by the indoor pressure reducing mechanism 17 such that it turns into a low-pressure, two-phase gas-liquid state and then flows into the use unit 303. The refrigerant flowing into the use unit 303 flows into the indoor heat exchanger 14 and exchanges heat with the indoor air supplied by the indoor air-sending device 15 such that it is evaporated into a low-pressure gas refrigerant. At this time, the opening degree of the indoor pressure reducing mechanism 17 is controlled by the control section 103 such that the degree of superheat of the refrigerant on the gas side of the indoor heat exchanger 14 is at a predetermined value. How to derive the degree of superheat is as explained in the heating only operation mode.

Since the indoor pressure reducing mechanism 17 controls the flow rate of the refrigerant flowing through the indoor heat exchanger 14 such that the degree of superheat of the refrigerant on the gas side of the indoor heat exchanger 14 is at the predetermined value, the low-pressure gas refrigerant obtained by evaporation in the indoor heat exchanger 14 is allowed to have the predetermined degree of superheat. As described above, the refrigerant flows through the indoor heat exchanger 14 such that the flow rate of the refrigerant depends on a cooling load required in the conditioned space in which the use unit 303 is installed.

The refrigerant, which has flowed out of the indoor heat exchanger 14, passes through the indoor gas pipe 13 and the branch unit 302, flows through the gas extension pipe 12, passes through the four-way valve 11, and then merges with the refrigerant flowing through the low-pressure bypass pipe 24.

Whereas, the refrigerant, which has flowed into the low-pressure bypass pipe 24, is depressurized by the low-pressure bypass pressure reducing mechanism 23 and is then heated on the low-pressure side of the subcooling heat exchanger 18 by the refrigerant flowing through the high-pressure side and then merges with the refrigerant which has passed through the four-way valve 11. After that, the resultant refrigerant flows into the accumulator 22.

At this time, the opening degree of the low-pressure bypass pressure reducing mechanism 23 is controlled by the control section 103 such that the difference between the medium pressure and the low pressure is at a predetermined value. How to derive the difference between the medium pressure and the low pressure is as explained in the heating only operation mode.

Whereas, the refrigerant, which has flowed into the suction bypass pipe 26, is depressurized by the suction pressure reducing mechanism 25 and then merges with the refrigerant which has flowed out of the accumulator 22. At this time, the opening degree of the suction pressure reducing mechanism 25 is controlled by the control section 103 so as to be fully closed.

The refrigerant, which has flowed into the accumulator 22, then merges with the refrigerant flowing through the suction bypass pipe 26. The resultant refrigerant is again sucked into the compressor 1.

In the air-conditioning and hot water supply combination system 100, in the case where high-temperature hot water supply (for example, hot water supply at 60 degrees C.) is performed in the cooling main operation mode when the outside air temperature is high, the indoor pressure reducing mechanism 17 controls the quantity of liquid refrigerant flowing through the low-pressure bypass pipe 24, thereby controlling the degree of superheat on the gas side of the indoor heat exchanger 14. Thus, an increase in pressure on the low-pressure side can be avoided. Note that a normal operation by the control section 103 controls the opening degree of the indoor pressure reducing mechanism 17 such that the degree of superheat on the gas side of the indoor heat exchanger 14 is at a predetermined value. Increasing the target value of the degree of superheat allows the indoor pressure reducing mechanism 17 to control the quantity of liquid refrigerant flowing through the low-pressure bypass pipe 24.

In the case where a pressure on the low-pressure side increases, the opening degree of the indoor pressure reducing mechanism 17 is set to be less than a predetermined value such that the liquid refrigerant is bypassed to the low-pressure bypass pipe 24, thus reducing the flow rate of the refrigerant flowing through the indoor heat exchanger 14. At the inlet of the accumulator 22, the refrigerant is a saturated gas. As the liquid refrigerant flowing into the low-pressure bypass pipe 24 increases in flow rate, therefore, the degree of superheat (SH) of the refrigerant on the gas side of the indoor heat exchanger 14 becomes higher. The higher the degree of superheat of the indoor heat exchanger 14, the more the gas refrigerant in the indoor heat exchanger 14. Thus, a pressure on the low-pressure side can be reduced. In addition, the low-pressure bypass pressure reducing mechanism 23 controls the degree of subcooling on the high-pressure liquid side of the subcooling heat exchanger 18 such that it is less than or equal to a predetermined value, thereby increasing the degree of superheat of the indoor heat exchanger 14. Thus, a pressure on the low-pressure side can be reduced.

Furthermore, normal operation control by the control section 103 controls the opening degree of the outdoor pressure reducing mechanism 19, thus allowing the refrigerant on the liquid side of the outdoor heat exchanger 20 to be a subcooled liquid. Accordingly, the liquid refrigerant is secured at the inlet of the low-pressure bypass pressure reducing mechanism 23. Setting the opening degree of the indoor pressure reducing mechanism 17 to be less than the predetermined value enables the liquid refrigerant to flow into the low-pressure bypass pipe, so that the liquid refrigerant is enabled to flow to the inlet of the accumulator 22.

As described above, in the air-conditioning and hot water supply combination system 100, the indoor pressure reducing mechanism 17 or the low-pressure bypass pressure reducing mechanism 23 controls the quantity of the liquid refrigerant flowing through the low-pressure bypass pipe 24 to control the degree of superheat on the gas side of the indoor heat exchanger 14, so that an increase in pressure on the low-pressure side can be avoided. A high hot water supply capacity can, therefore, be achieved even under high-temperature outside air conditions.

In addition, the degree of subcooling on the liquid side of the hot water supply side heat exchanger 5 is controlled in the same way as in the heating only operation mode, so that an increase in pressure on the high-pressure side can be avoided and a highly efficient operation state can be achieved.

Furthermore, if the discharge temperature increases in the case where the hot water supply operation is performed under low-temperature outside air conditions where the outside air temperature is low, the opening degree of the suction pressure reducing mechanism 25 is set to be greater than a predetermined value, so that an increase in discharge temperature can be avoided.

As described above, in the air-conditioning and hot water supply combination system 100, the hot water supply capacity can be secured while the operation efficiency is high even under high-temperature outside air conditions. In the air-conditioning and hot water supply combination system 100, therefore, even while the use unit 303 performs the cooling operation or the heating operation and the hot water supply unit 304 simultaneously performs the hot water supply operation during normal operation including the heating only operation mode, the heating main operation mode, the cooling main operation mode, and the cooling main operation mode under high-temperature outside air conditions, the operations can be achieved with high efficiency.

In the case where a refrigerant, such as carbon dioxide, having a working pressure at or above its critical pressure is used, since the refrigerant turns into a liquid refrigerant at or below its pseudo-critical temperature, the description of Embodiment 1 can be applied to this case, provided that the degree of subcooling is defined using the pseudo-critical temperature instead of a saturation temperature.

Embodiment 2

Figure 6:
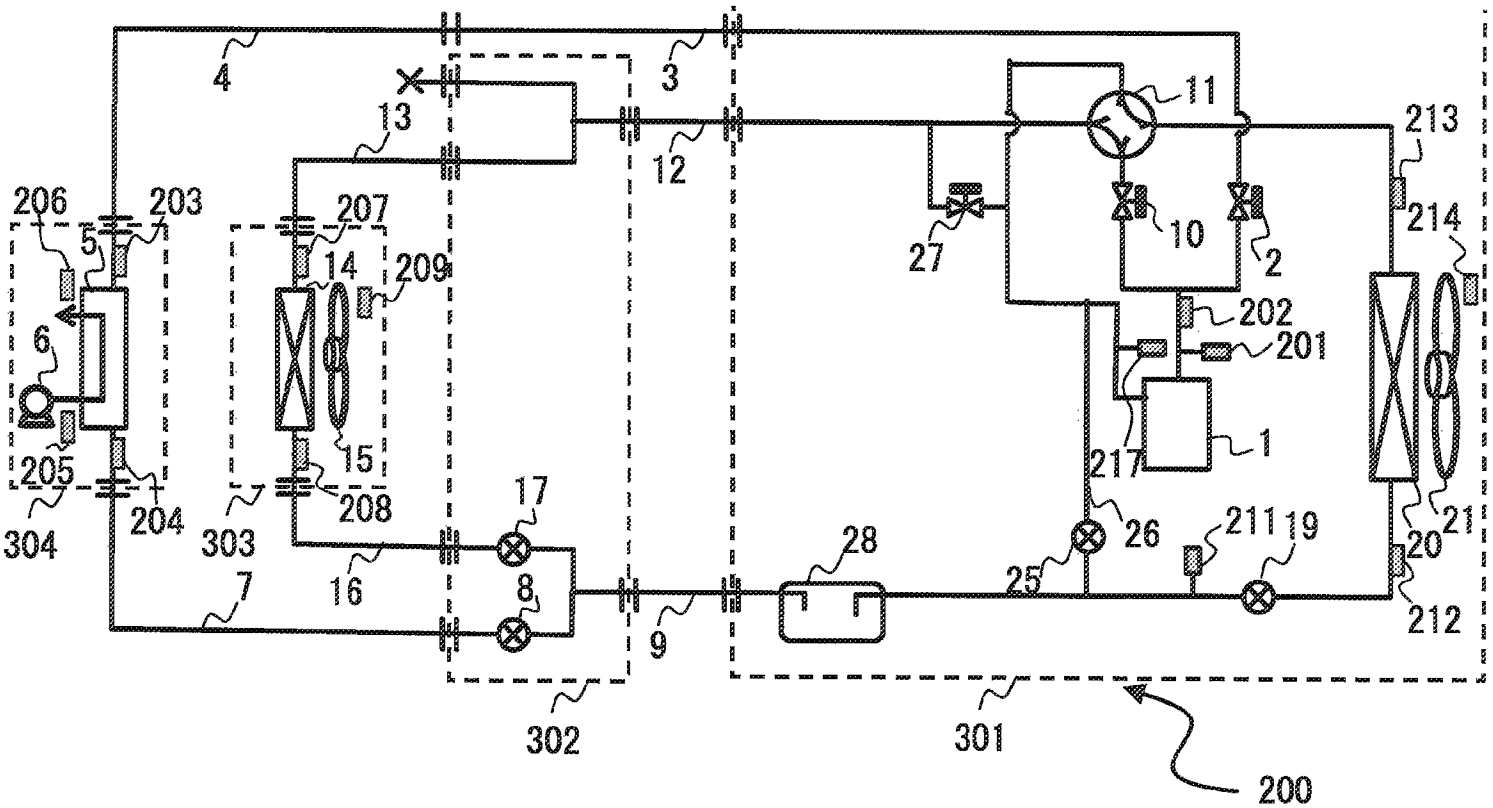
FIG. 6 is a refrigerant circuit diagram illustrating the configuration of a refrigerant circuit in an air-conditioning and hot water supply combination system according to Embodiment 2 of the present invention.

FIG. 6 is a refrigerant circuit diagram illustrating the configuration of a refrigerant circuit of an air-conditioning and hot water supply combination system 200 according to Embodiment 2 of the present invention. The configuration and operation of the air-conditioning and hot water supply combination system 200 will be described with reference to FIG. 6. The difference between Embodiment 2 and Embodiment 1 discussed above will be mainly described. Components having the same functions as those in Embodiment 1 are designated by the same reference numerals and description of the components will be omitted.

This air-conditioning and hot water supply combination system 200 is a 3-pipe multi-system air-conditioning and hot water supply combination system which performs a thermo-compression refrigeration cycle operation to simultaneously enable a cooling operation or heating operation selected in a use side unit and a hot water supply operation in a hot water supply unit. This air-conditioning and hot water supply combination system 200 can simultaneously perform an air-conditioning operation and the hot water supply operation and can also maintain a high temperature for hot water supply and achieve highly efficient operations even under high-temperature outside air conditions.

[System Configuration]

The air-conditioning and hot water supply combination system 200 has such a circuit configuration that the bypass (low-pressure bypass pipe 24), the low-pressure bypass pressure reducing mechanism 23, the subcooling heat exchanger 18, and the accumulator 22 are removed from the air-conditioning and hot water supply combination system 100 according to Embodiment 1 and the receiver 28 having a function as a liquid receiver for storing a medium-pressure or high-pressure excess refrigerant is disposed in the liquid extension pipe 9 between the branch unit 302 and the branch point between the outdoor pressure reducing mechanism 19 and the suction pressure reducing mechanism 25. In other words, an outdoor side refrigerant circuit included in the heat source unit 301 includes, as components, the compressor 1, the four-way valve 11, the outdoor heat exchanger 20, the three solenoid valves, the outdoor pressure reducing mechanism 19, the suction pressure reducing mechanism 25, and the receiver 28.

[Operation]

The air-conditioning and hot water supply combination system 200 can execute four operation modes (the heating only operation mode, the heating main operation mode, the cooling main operation mode, and the cooling only operation mode) in a manner similar to the air-conditioning and hot water supply combination system 100 according to Embodiment 1.

The air-conditioning and hot water supply combination system 200 includes no accumulator. An excess refrigerant is stored in the receiver 28. Accordingly, in the case where a pressure on a low-pressure side increases at a hot water supply load under high-temperature outside air conditions, if the degree of superheat is increased by an evaporator, a pressure on a high-pressure side will not increase, because an excess refrigerant is stored in the receiver 28 on the high-pressure side. In the heating only operation mode and the heating main operation mode in which the outdoor heat exchanger 20 functions as a refrigerant evaporator, therefore, the opening degree of the outdoor pressure reducing mechanism 19 is set to be less than a predetermined value such that the degree of superheat on the gas side of the outdoor heat exchanger 20 is increased, thus avoiding an increase in pressure on the low-pressure side. Furthermore, in the cooling main operation mode in which the indoor heat exchanger 14 functions as an evaporator, the opening degree of the indoor pressure reducing mechanism 17 is set to be less than a predetermined value such that the degree of superheat on the gas side of the indoor heat exchanger 14 is increased, thus avoiding an increase in pressure on the low-pressure side.

Furthermore, in the case where a discharge temperature increases under high-temperature outside air conditions, the opening degree of the outdoor pressure reducing mechanism 19 is set to be greater than the predetermined value such that the degree of superheat on the gas side of the outdoor heat exchanger 20 is reduced, thus reducing the degree of suction superheat of the compressor 1. Consequently, the discharge temperature of the compressor 1 can be reduced.

Furthermore, the degree of subcooling on the liquid side of the hot water supply side heat exchanger 5 is controlled in the same way as in the air-conditioning and hot water supply combination system 100 according to Embodiment 1, thus avoiding an increase in pressure on the high-pressure side and achieving a highly efficient operation state.

As in the air-conditioning and hot water supply combination system 100 according to Embodiment 1, in the heating main operation mode, in the case where the difference between an outside air temperature detected by the outside air temperature sensor 214 and an evaporating temperature is less than or equal to a predetermined value (for example, at or below 2 degrees C.), there is hardly any difference in temperature between the refrigerant and the air in the outdoor heat exchanger 20 and the quantity of heat removed from the outside air by the refrigerant is small. In such an operation state, the opening degree of the outdoor pressure reducing mechanism 19 is set to be less than the predetermined value. Alternatively, the outdoor pressure reducing mechanism 19 is fully closed such that the indoor heat exchanger 14 performs an exhaust heat full recovery operation, thus achieving a highly efficient operation state.

Furthermore, as in the air-conditioning and hot water supply combination system 100 according to Embodiment 1, if the discharge temperature increases in the case where the hot water supply operation is performed under low-temperature outside air conditions, the opening degree of the suction pressure reducing mechanism 25 is set to be greater than a predetermined value, so that an increase in discharge temperature can be avoided.

REFERENCE SIGNS LIST

1, compressor; 2, first solenoid valve; 3, hot water supply extension pipe; 4, hot water supply gas pipe; 5, hot water supply side heat exchanger; 6, water supply pump; 7, hot water supply liquid pipe; 8, hot water supply pressure reducing mechanism; 9, liquid extension pipe; 10, second solenoid valve; 11, four-way valve; 12, gas extension pipe; 13, indoor gas pipe; 14, indoor heat exchanger; 15, indoor air-sending device; 16, indoor liquid pipe; 17, indoor pressure reducing mechanism; 18, subcooling heat exchanger; 19, outdoor pressure reducing mechanism; 20, outdoor heat exchanger; 21, outdoor air-sending device; 22, accumulator; 23, low-pressure bypass pressure reducing mechanism; 24, low-pressure bypass pipe; 25, suction pressure reducing mechanism; 26, suction bypass pipe; 27, third solenoid valve; 28, receiver; 100, air-conditioning and hot water supply combination system; 101 measuring section; 102, calculating section; 103, control section; 200, air-conditioning and hot water supply combination system; 201, discharge pressure sensor; 203, hot water supply gas temperature sensor; 204, hot water supply liquid temperature sensor; 205, water inlet temperature sensor; 206, water outlet temperature sensor; 207, indoor gas temperature sensor; 208, indoor liquid temperature sensor; 209, indoor suction temperature sensor; 210, medium-pressure liquid temperature sensor; 211, medium pressure sensor; 212, outdoor liquid temperature sensor; 213, outdoor gas temperature sensor; 214, outside air temperature sensor; 215, low-pressure liquid temperature sensor; 216, low-pressure gas temperature sensor; 217, suction pressure sensor; 301, heat source unit; 302, branch unit; 303, use unit; and 304, hot water supply unit.

The invention claimed is:

1. An air-conditioning and hot water supply combination system comprising:

one or a plurality of use units each equipped with at least a use side heat exchanger;

one or a plurality of hot water supply units each equipped with at least a hot water supply side heat exchanger;

one or a plurality of heat source units connected to the use units and the hot water supply units, each heat source unit being equipped with a compressor, a heat source side heat exchanger, a heat source side pressure reducing mechanism, a bypass that bypasses a liquid refrigerant on a high-pressure side to a low-pressure side, a low-pressure bypass pressure reducing mechanism disposed in the bypass, an accumulator, and a subcooling heat exchanger that exchanges heat between the liquid refrigerant on the high-pressure side and the refrigerant on the low-pressure side flowing through the bypass; and one or a plurality of branch units connected to the use units, the hot water supply units, and the heat source units, each branch unit including a use side pressure reducing mechanism that controls the flow of the refrigerant flowing into the use unit in accordance with an operation state in the use unit, and a hot water supply pressure reducing mechanism that controls the flow of the refrigerant flowing into the hot water supply unit in accordance with an operation state in the hot water supply unit, wherein when an evaporating pressure or an evaporating temperature calculated from the evaporating pressure reaches a first predetermined value or higher, the degree of superheat of the refrigerant on the low-pressure gas side of the subcooling heat exchanger or the degree of subcooling of the refrigerant on the high-pressure liquid side of the subcooling heat exchanger is controlled by the opening degree of the low-pressure bypass pressure reducing mechanism, such that the evaporating pressure or the evaporating temperature calculated from the evaporating pressure is less than or equal to the first predetermined value.

2. The air-conditioning and hot water supply combination system of claim 1, wherein when the heat source side heat exchanger functions as a refrigerant evaporator, the opening degree of the low-pressure bypass pressure reducing mechanism is controlled such that the degree of superheat of the refrigerant on the low-pressure gas side of the subcooling heat exchanger is at a predetermined value, and wherein when the heat source side heat exchanger functions as a refrigerant condenser, the opening degree of the low-pressure bypass pressure reducing mechanism is controlled such that the degree of subcooling of the refrigerant on the high-pressure liquid side of the subcooling heat exchanger is at a predetermined value.

3. The air-conditioning and hot water supply combination system of claim 2, further comprising:

a second bypass that connects a point between the subcooling heat exchanger or the receiver and the heat source side pressure reducing mechanism to suction part of the compressor; and a suction pressure reducing mechanism disposed in the second bypass, wherein when a discharge temperature of the refrigerant discharged from the compressor reaches a sixth predetermined value or higher, the opening degree of the suction pressure reducing mechanism is controlled such that the discharge temperature is less than or equal to the sixth predetermined value.

4. The air-conditioning and hot water supply combination system of claim 1, wherein when a condensing pressure or a condensing temperature calculated from a discharge pressure of the refrigerant discharged from the compressor reaches a second predetermined value or higher, the degree of subcooling on the liquid side of the hot water supply heat exchanger is controlled by the opening degree of the hot water supply pressure reducing mechanism, such that the condensing pressure or the condensing temperature calculated from the discharge pressure of the refrigerant discharged from the compressor is less than or equal to the second predetermined value.

5. The air-conditioning and hot water supply combination system of claim 4, wherein the degree of subcooling on the liquid side of the hot water supply heat exchanger is controlled by the opening degree of the hot water supply pressure reducing mechanism such that the highest operation efficiency is achieved.

6. The air-conditioning and hot water supply combination system of claim 4, wherein when the degree of superheat on the gas side of the heat source side heat exchanger is greater than or equal to a third predetermined value and a discharge temperature of the refrigerant discharged from the compressor is greater than or equal to a fourth predetermined value, the opening degree of the low-pressure bypass pressure reducing mechanism is set to be greater than a predetermined value in order to reduce the degree of superheat on the gas side of the heat source side heat exchanger such that the discharge temperature is less than or equal to the fourth predetermined value.

7. The air-conditioning and hot water supply combination system of claim 1, wherein when the degree of superheat on the gas side of the heat source side heat exchanger is greater than or equal to a third predetermined value and a discharge temperature of the refrigerant discharged from the compressor is greater than or equal to a fourth predetermined value, the opening degree of the low-pressure bypass pressure reducing mechanism is set to be greater than a predetermined value in order to reduce the degree of superheat on the gas side of the heat source side heat exchanger such that the discharge temperature is less than or equal to the fourth predetermined value.

8. The air-conditioning and hot water supply combination system of claim 1, wherein when the difference between an outside air temperature and the evaporating temperature is less than or equal to a fifth predetermined value during operation in which the use side heat exchanger functions as a refrigerant evaporator, the hot water supply heat exchanger functions as a refrigerant condenser, and the heat source side heat exchanger functions as a refrigerant evaporator, the opening degree of the heat source side pressure reducing mechanism is set to be less than a predetermined value or fully closed such that an exhaust heat full recovery operation is performed.

9. The air-conditioning and hot water supply combination system of claim 1, further comprising:

a second bypass that connects a point between the subcooling heat exchanger or the receiver and the heat source side pressure reducing mechanism to suction part of the compressor; and a suction pressure reducing mechanism disposed in the second bypass, wherein when a discharge temperature of the refrigerant discharged from the compressor reaches a sixth predetermined value or higher, the opening degree of the suction pressure reducing mechanism is controlled such that the discharge temperature is less than or equal to the sixth predetermined value.

10. The air-conditioning and hot water supply combination system of claim 1, wherein a refrigerant having a working pressure at or above its critical pressure is used and the degree of subcooling is obtained on the basis of a pseudo-critical temperature.

11. An air-conditioning and hot water supply combination system, comprising:

one or a plurality of use units each equipped with at least a use side heat exchanger;

one or a plurality of hot water supply units each equipped with at least a hot water supply side heat exchanger;

one or a plurality of heat source units connected to the use units and the hot water supply units, each heat source unit being equipped with a compressor, a heat source side heat exchanger, a heat source side pressure reducing mechanism, and a receiver; and one or a plurality of branch units connected to the use units, the hot water supply units, and the heat source units, each branch unit being equipped with a use side pressure reducing mechanism that controls the flow of a refrigerant flowing into the use unit in accordance with an operation state in the use unit, and a hot water supply pressure reducing mechanism that controls the flow of the refrigerant flowing into the hot water supply unit in accordance with an operation state in the hot water supply unit, wherein when an evaporating pressure or an evaporating temperature calculated from the evaporating pressure reaches a first predetermined value or higher, the degree of superheat on the gas side of the heat source side heat exchanger or the degree of superheat on the gas side of the use side heat exchanger is controlled by the opening degree of the heat source side pressure reducing mechanism or the use side pressure reducing mechanism, such that the evaporating pressure or the evaporating temperature calculated from the evaporating pressure is less than or equal to the first predetermined value, and wherein when a condensing pressure or a condensing temperature calculated from a discharge pressure of the refrigerant discharged from the compressor reaches a second predetermined value or higher, the degree of subcooling on the liquid side of the hot water supply heat exchanger is controlled by the opening degree of the hot water supply pressure reducing mechanism, such that the condensing pressure or the condensing temperature calculated from the discharge pressure of the refrigerant discharged from the compressor is less than or equal to the second predetermined value.

12. The air-conditioning and hot water supply combination system of claim 11, wherein when the heat source side heat exchanger functions as a refrigerant evaporator, the opening degree of the heat source side pressure reducing mechanism is controlled such that the degree of superheat on the gas side of the heat source side heat exchanger is at a predetermined value, and wherein when the heat source side heat exchanger functions as a refrigerant condenser, the opening degree of the use side pressure reducing mechanism is controlled such that the degree of superheat on the gas side of the use side heat exchanger is at a predetermined value.

13. The air-conditioning and hot water supply combination system of claim 11, wherein the degree of subcooling on the liquid side of the hot water supply heat exchanger is controlled by the opening degree of the hot water supply pressure reducing mechanism such that the highest operation efficiency is achieved.

14. The air-conditioning and hot water supply combination system of claim 11, wherein a refrigerant having a working pressure at or above its critical pressure is used and the degree of subcooling is obtained on the basis of a pseudo-critical temperature.

15. An air-conditioning and hot water supply combination system, comprising:

one or a plurality of use units each equipped with at least a use side heat exchanger;

one or a plurality of hot water supply units each equipped with at least a hot water supply side heat exchanger;

one or a plurality of heat source units connected to the use units and the hot water supply units, each heat source unit being equipped with a compressor, a heat source side heat exchanger, a heat source side pressure reducing mechanism, and a receiver; and one or a plurality of branch units connected to the use units, the hot water supply units, and the heat source units, each branch unit being equipped with a use side pressure reducing mechanism that controls the flow of a refrigerant flowing into the use unit in accordance with an operation state in the use unit, and a hot water supply pressure reducing mechanism that controls the flow of the refrigerant flowing into the hot water supply unit in accordance with an operation state in the hot water supply unit, wherein when an evaporating pressure or an evaporating temperature calculated from the evaporating pressure reaches a first predetermined value or higher, the degree of superheat on the gas side of the heat source side heat exchanger or the degree of superheat on the gas side of the use side heat exchanger is controlled by the opening degree of the heat source side pressure reducing mechanism or the use side pressure reducing mechanism, such that the evaporating pressure or the evaporating temperature calculated from the evaporating pressure is less than or equal to the first predetermined value, and wherein when the difference between an outside air temperature and the evaporating temperature is less than or equal to a fifth predetermined value during operation in which the use side heat exchanger functions as a refrigerant evaporator, the hot water supply heat exchanger functions as a refrigerant condenser, and the heat source side heat exchanger functions as a refrigerant evaporator, the opening degree of the heat source side pressure reducing mechanism is set to be less than a predetermined value or fully closed such that an exhaust heat full recovery operation is performed.

* * * * *